US009074815B2

(12) United States Patent
Malsam

(10) Patent No.: US 9,074,815 B2
(45) Date of Patent: Jul. 7, 2015

(54) NITROGEN REMOVAL WITH ISO-PRESSURE OPEN REFRIGERATION NATURAL GAS LIQUIDS RECOVERY

(71) Applicant: Lummus Technology Inc., Bloomfield, NJ (US)

(72) Inventor: Michael Malsam, Sugar Land, TX (US)

(73) Assignee: Lummus Technology Inc., Bloomfield, NJ (US)

( * ) Notice: Subject to any disclaimer, the term of this patent is extended or adjusted under 35 U.S.C. 154(b) by 0 days.

(21) Appl. No.: 14/141,064

(22) Filed: Dec. 26, 2013

(65) Prior Publication Data

US 2014/0130541 A1 May 15, 2014

Related U.S. Application Data

(62) Division of application No. 12/397,837, filed on Mar. 4, 2009, now Pat. No. 8,627,681.

(51) Int. Cl.
*F25J 3/00* (2006.01)
*F25J 3/02* (2006.01)
(Continued)

(52) U.S. Cl.
CPC ..... *F25J 3/0209* (2013.01); *F25J 2220/62* (2013.01); *F25J 2215/42* (2013.01); *F25J 2215/60* (2013.01); *C10L 3/105* (2013.01); *C10L 3/10* (2013.01); *F25J 3/0233* (2013.01);
(Continued)

(58) Field of Classification Search
CPC ..... F25J 3/0233; F25J 3/0238; F25J 3/0242; F25J 3/0257; F25J 3/0209; F25J 2215/02; F25J 2215/60; F25J 2215/62; F25J 2215/42; F25J 2220/62; F25J 2205/80; F25J 2245/02; F25J 2245/42; F25J 2270/02; F25J 2270/12; F25J 2270/60; F25J 2270/88
USPC ..... 62/611, 618, 630, 927, 620, 631; 95/46, 95/50–56
See application file for complete search history.

(56) References Cited

U.S. PATENT DOCUMENTS 5,685,170 A * 11/1997 Sorensen ..... 62/625
6,401,486 B1 * 6/2002 Lee et al. ..... 62/630
(Continued)

OTHER PUBLICATIONS

Search Report for Application No. GB1003222.5 dated May 24, 2010.

*Primary Examiner* — Frantz Jules
*Assistant Examiner* — Keith Raymond
(74) *Attorney, Agent, or Firm* — Alix, Yale & Ristas, LLP

(57) ABSTRACT

A process for recovery of natural gas liquids is disclosed, the process including: fractionating a gas stream comprising nitrogen, methane, ethane, and propane and other $C_{3+}$ hydrocarbons into at least two fractions including a light fraction comprising nitrogen, methane, ethane, and propane, and a heavy fraction comprising propane and other $C_{3+}$ hydrocarbons; separating the light fraction into at least two fractions including a nitrogen-enriched fraction and a nitrogen-depleted fraction in a first separator; separating the nitrogen-depleted fraction into a propane-enriched fraction and a propane-depleted fraction in a second separator; feeding at least a portion of the propane-enriched fraction to the fractionating as a reflux; recycling at least a portion of the propane-depleted fraction to the first separator. In some embodiments, the nitrogen-enriched fraction may be separated in a nitrogen removal unit to produce a nitrogen-depleted natural gas stream and a nitrogen-enriched natural gas stream.

18 Claims, 7 Drawing Sheets

(51) Int. Cl.
*C10L 3/10* (2006.01)
*F25J 1/00* (2006.01)

(52) U.S. Cl.
CPC ..... *F25J3/0238* (2013.01); *F25J 3/0242* (2013.01); *F25J 3/0257* (2013.01); *F25J 2200/04* (2013.01); *F25J 2200/40* (2013.01); *F25J 2200/78* (2013.01); *F25J 2200/94* (2013.01); *F25J 2205/40* (2013.01); *F25J 2205/80* (2013.01); *F25J 2215/02* (2013.01); *F25J 2215/62* (2013.01); *F25J 2230/60* (2013.01); *F25J 2245/02* (2013.01); *F25J 2245/42* (2013.01); *F25J 2270/02* (2013.01); *F25J 2270/12* (2013.01); *F25J 2270/60* (2013.01); *F25J 2270/88* (2013.01); *F25J 1/0022* (2013.01)

(56) References Cited

U.S. PATENT DOCUMENTS

| | | | | |
|---|---|---|---|---|
| 6,425,267 | B1 | 7/2002 | Baker et al. | |
| 7,234,322 | B2 * | 6/2007 | Hahn et al. | 62/620 |
| 7,604,681 | B2 * | 10/2009 | Malsam et al. | 95/45 |
| 2003/0005722 | A1 | 1/2003 | Wilkinson et al. | |
| 2008/0028790 | A1 | 2/2008 | Wilkinson et al. | |
| 2009/0277217 | A1 * | 11/2009 | Ransbarger et al. | 62/612 |
| 2009/0282864 | A1 | 11/2009 | Malsam | |

* cited by examiner

NITROGEN REMOVAL WITH ISO-PRESSURE OPEN REFRIGERATION NATURAL GAS LIQUIDS RECOVERY

This application is a divisional of U.S. application Ser. No. 12/397,837 filed on Mar. 4, 2009.

BACKGROUND OF DISCLOSURE

1. Field of the Disclosure

Embodiments disclosed herein relate generally to processes for recovery of natural gas liquids from gas feed streams containing hydrocarbons, and in particular to recovery of methane and ethane from gas feed streams.

2. Background

Natural gas contains various hydrocarbons, including methane, ethane and propane. Natural gas usually has a major proportion of methane and ethane, i.e, methane and ethane together typically comprise at least 50 mole percent of the gas. The gas also contains relatively lesser amounts of heavier hydrocarbons such as propane, butanes, pentanes and the like, as well as hydrogen, nitrogen, carbon dioxide and other gases. In addition to natural gas, other gas streams containing hydrocarbons may contain a mixture of lighter and heavier hydrocarbons. For example, gas streams formed in the refining process can contain mixtures of hydrocarbons to be separated. Separation and recovery of these hydrocarbons can provide valuable products that may be used directly or as feedstocks for other processes. These hydrocarbons are typically recovered as natural gas liquids (NGL).

Recovery of natural gas liquids from a gas feed stream has been performed using various processes, such as cooling and refrigeration of gas, oil absorption, refrigerated oil absorption or through the use of multiple distillation towers. More recently, cryogenic expansion processes utilizing Joule-Thompson valves or turbo expanders have become preferred processes for recovery of NGL from natural gas.

In a typical cryogenic expansion recovery process, a feed gas stream under pressure is cooled by heat exchange with other streams of the process and/or external sources of refrigeration such as a propane compression-refrigeration system. As the gas is cooled, liquids may be condensed and collected in one or more separators as high pressure liquids containing the desired components.

The high-pressure liquids may be expanded to a lower pressure and fractionated. The expanded stream, comprising a mixture of liquid and vapor, is fractionated in a distillation column. In the distillation column volatile gases and lighter hydrocarbons are removed as overhead vapors and heavier hydrocarbon components exit as liquid product in the bottoms.

The feed gas is typically not totally condensed, and the vapor remaining from the partial condensation may be passed through a Joule-Thompson valve or a turbo expander to a lower pressure at which further liquids are condensed as a result of further cooling of the stream. The expanded stream is supplied as a feed stream to the distillation column. A reflux stream is provided to the distillation column, typically a portion of partially condensed feed gas after cooling but prior to expansion. Various processes have used other sources for the reflux, such as a recycled stream of residue gas supplied under pressure.

Additional processing of the resulting natural gas from the above described cryogenic separations is often required, as the nitrogen content of the natural gas is often above acceptable levels for pipeline sales. Typically, only 4 percent nitrogen or nitrogen plus other inert gases are allowed in the gas due to regulations and pipeline specifications. Nitrogen is often removed with cryogenic separation, similar to separating air into nitrogen and oxygen. Some nitrogen removal processes use pressure swing adsorption, absorption, membranes, and/or other technology, where such processes are typically placed in series with the cryogenic natural gas liquids recovery.

While various improvements to the natural gas recovery processes with nitrogen removal described above have been attempted, there remains a need in the art for improved process for enhanced recovery of NGLs from a natural gas feed stream.

SUMMARY OF THE DISCLOSURE

In one aspect, embodiments disclosed herein relate to processes for recovery of natural gas liquids, including: fractionating a gas stream comprising nitrogen, methane, ethane, and propane and other $C_{3+}$ hydrocarbons into at least two fractions including a light fraction comprising nitrogen, methane, ethane, and propane, and a heavy fraction comprising propane and other $C_{3+}$ hydrocarbons; separating the light fraction into at least three fractions, including an overheads fraction enriched in nitrogen, a bottoms fraction depleted in nitrogen, and a side draw fraction of intermediate nitrogen content, in a first separator; separating the nitrogen-depleted fraction into a propane-enriched fraction and a propane-depleted fraction in a second separator; feeding at least a portion of the propane-enriched fraction to the fractionating as a reflux; recycling a portion of the propane-depleted fraction to the first separator; and withdrawing a portion of the propane-depleted fraction as a natural gas liquids product stream.

In another aspect, embodiments disclosed herein relate to processes for recovery of natural gas liquids from a gas stream including nitrogen, methane, ethane, and propane, among other components. The process may include: fractionating a gas stream comprising nitrogen, methane, ethane, and propane and other $C_{3+}$ hydrocarbons into at least two fractions including a light fraction comprising nitrogen, methane, ethane, and propane, and a heavy fraction comprising propane and other $C_{3+}$ hydrocarbons; separating the light fraction into at least two fractions including a nitrogen-enriched fraction and a nitrogen-depleted fraction in a first separator; separating the nitrogen-depleted fraction into a propane-enriched fraction and a propane-depleted fraction in a second separator; feeding at least a portion of the propane-enriched fraction to the fractionating as a reflux; recycling at least a portion of the propane-depleted fraction to the first separator; and separating the nitrogen-enriched fraction in a nitrogen removal unit to produce a nitrogen-depleted natural gas stream and a nitrogen-enriched natural gas stream.

In another aspect, embodiments disclosed herein relate to processes for recovery of natural gas liquids, including: fractionating a gas stream comprising nitrogen, methane, ethane, and propane and other $C_{3+}$ hydrocarbons into at least two fractions including a light fraction comprising nitrogen, methane, ethane, and propane, and a heavy fraction comprising propane and other $C_{3+}$ hydrocarbons; separating the light fraction into at least two fractions including a nitrogen-enriched fraction and a nitrogen-depleted fraction in a first separator; compressing and cooling the nitrogen-depleted fraction; separating the compressed and cooled nitrogen-depleted fraction into a propane-enriched fraction and a propane-depleted fraction in a second separator; feeding at least a portion of the propane-enriched fraction to the fractionating as a reflux; recycling at least a portion of the propane-depleted fraction to the first separator; exchanging heat between two or more of the gas stream, the light fraction, a portion of the propane-depleted fraction, the nitrogen-enriched fraction, the nitrogen-depleted fraction, the compressed and cooled nitrogen-depleted fraction, and a refrigerant; and separating the nitrogen-enriched fraction in a nitrogen removal unit comprising: separating the nitrogen-enriched fraction in a first membrane separation stage to produce a first nitrogen-depleted natural gas stream and a first nitrogen-enriched natural gas stream; separating the nitrogen-enriched fraction in a second membrane separation stage to produce a second nitrogen-depleted natural gas stream and a second nitrogen-enriched natural gas stream; and recycling at least a portion of the second nitrogen-depleted natural gas stream to the separating in a first membrane separation stage.

In another aspect, embodiments disclosed herein relate to processes for recovery of natural gas liquids, including: fractionating a gas stream comprising nitrogen, methane, ethane, and propane and other $C_{3+}$ hydrocarbons into at least two fractions including a light fraction comprising nitrogen, methane, ethane, and propane, and a heavy fraction comprising propane and other $C_{3+}$ hydrocarbons; separating the light fraction into at least two fractions including a nitrogen-enriched fraction and a nitrogen-depleted fraction in a first separator; compressing and cooling the nitrogen-depleted fraction; separating the compressed and cooled nitrogen-depleted fraction into a propane-enriched fraction and a propane-depleted fraction in a second separator; feeding at least a portion of the propane-enriched fraction to the fractionating as a reflux; recycling at least a portion of the propane-depleted fraction to the first separator; exchanging heat between two or more of the gas stream, the light fraction, a portion of the propane-depleted fraction, the nitrogen-enriched fraction, the nitrogen-depleted fraction, the compressed and cooled nitrogen-depleted fraction, and a refrigerant; and separating the nitrogen-enriched fraction in a nitrogen removal unit comprising: separating the nitrogen-enriched fraction in a first membrane separation stage to produce a first nitrogen-depleted natural gas stream and a first nitrogen-enriched natural gas stream; separating the nitrogen-enriched fraction in a second membrane separation stage to produce a second nitrogen-depleted natural gas stream and a second nitrogen-enriched natural gas stream; recovering the first nitrogen-depleted natural gas stream as a high-btu natural gas product stream; recovering the second nitrogen-depleted natural gas stream as an intermediate-btu natural gas product stream; and recovering the second nitrogen-enriched natural gas stream as a low-btu natural gas product stream.

In another aspect, embodiments disclosed herein relate to processes for recovery of natural gas liquids, including: fractionating a gas stream comprising nitrogen, methane, ethane, and propane and other $C_{3+}$ hydrocarbons into at least two fractions including a light fraction comprising nitrogen, methane, ethane, and propane, and a heavy fraction comprising propane and other $C_{3+}$ hydrocarbons; separating the light fraction into at least two fractions including a nitrogen-enriched fraction and a nitrogen-depleted fraction in a first separator; compressing and cooling the nitrogen-depleted fraction; separating the compressed and cooled nitrogen-depleted fraction into a propane-enriched fraction and a propane-depleted fraction in a second separator; feeding at least a portion of the propane-enriched fraction to the fractionating as a reflux; feeding a portion of the propane-depleted fraction to the first separator; withdrawing a portion of the propane-depleted fraction; exchanging heat between two or more of the gas stream, the light fraction, a portion of the propane-depleted fraction, the nitrogen-enriched fraction, the nitrogen-depleted fraction, the withdrawn portion, the compressed and cooled nitrogen-depleted fraction, and a refrigerant; and separating the nitrogen-enriched fraction in a nitrogen removal unit comprising: separating the nitrogen-enriched fraction in a first membrane separation stage to produce a first nitrogen-depleted natural gas stream and a first nitrogen-enriched natural gas stream; separating the nitrogen-enriched fraction in a second membrane separation stage to produce a second nitrogen-depleted natural gas stream and a second nitrogen-enriched natural gas stream; and recycling at least a portion of the second nitrogen-depleted natural gas stream to the separating in a first membrane separation stage; and admixing the withdrawn portion and the first nitrogen-depleted natural gas stream to form a natural gas product stream.

In another aspect, embodiments disclosed herein relate to processes for recovery of natural gas liquids, including: fractionating a gas stream comprising nitrogen, methane, ethane, and propane and other $C_{3+}$ hydrocarbons into at least two fractions including a light fraction comprising nitrogen, methane, ethane, and propane, and a heavy fraction comprising propane and other $C_{3+}$ hydrocarbons; separating the light fraction into at least three fractions including a nitrogen-enriched fraction, an intermediate nitrogen-content fraction, and a nitrogen-depleted fraction in a first separator; compressing and cooling the nitrogen-depleted fraction; separating the compressed and cooled nitrogen-depleted fraction into a propane-enriched fraction and a propane-depleted fraction in a second separator; feeding at least a portion of the propane-enriched fraction to the fractionating as a reflux; recycling at least a portion of the propane-depleted fraction to the first separator; exchanging heat between two or more of the gas stream, the light fraction, a portion of the propane-depleted fraction, the nitrogen-enriched fraction, the nitrogen-depleted fraction, the compressed and cooled nitrogen-depleted fraction, the intermediate nitrogen-content fraction, and a refrigerant; and separating the nitrogen-enriched fraction in a nitrogen removal unit comprising: separating the nitrogen-enriched fraction in a first membrane separation stage to produce a first nitrogen-depleted natural gas stream and a first nitrogen-enriched natural gas stream; separating the nitrogen-enriched fraction in a second membrane separation stage to produce a second nitrogen-depleted natural gas stream and a second nitrogen-enriched natural gas stream; and recycling at least a portion of the second nitrogen-depleted natural gas stream to the separating in a first membrane separation stage; and admixing the intermediate nitrogen-content fraction and the first nitrogen-depleted natural gas stream to form a natural gas product stream.

Other aspects and advantages will be apparent from the following description and the appended claims.

DETAILED DESCRIPTION

Figure 1:
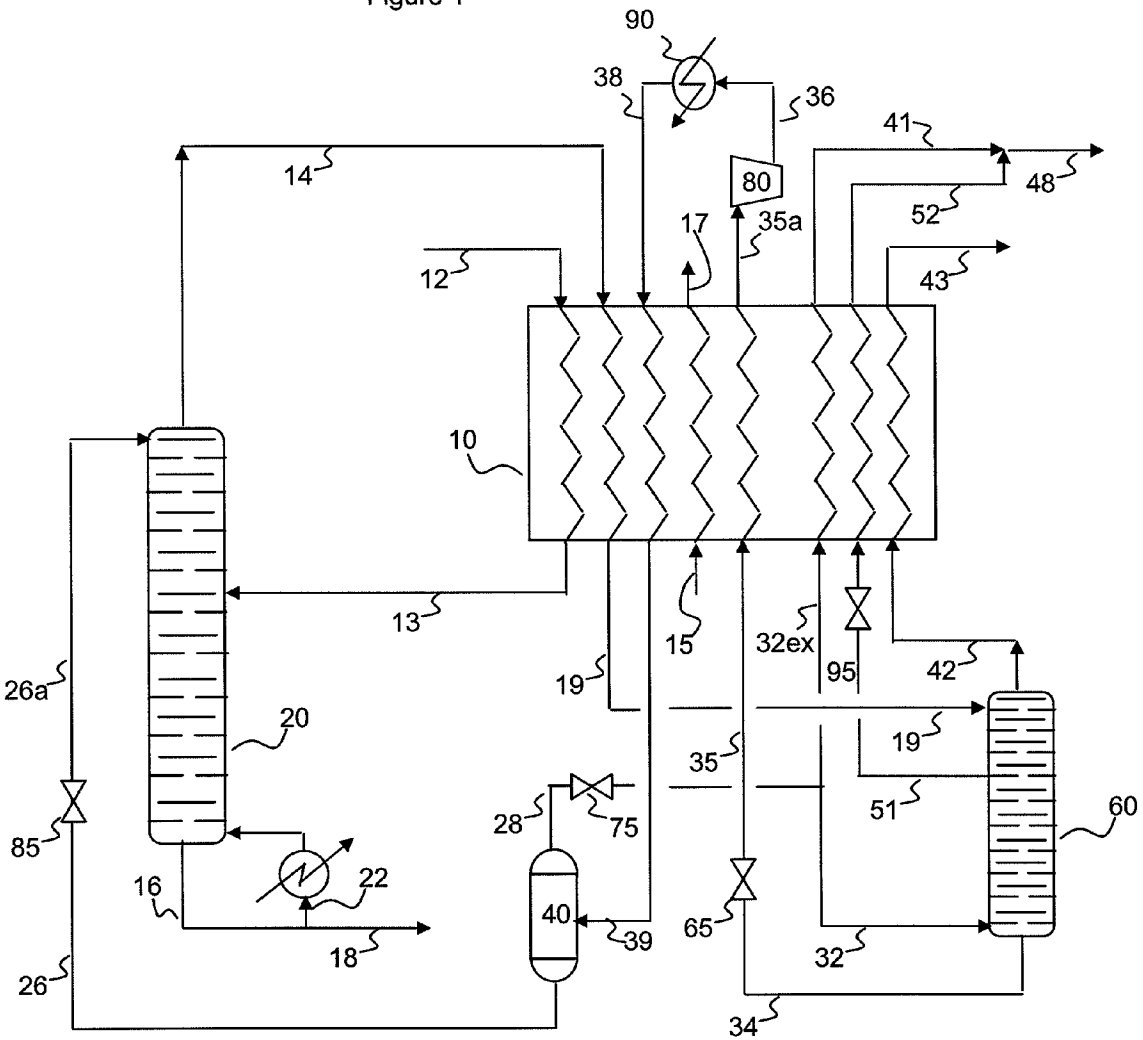
FIG. 1 is a simplified flow diagram of an iso-pressure open refrigeration natural gas liquids recovery process according to embodiments disclosed herein.

Processes disclosed herein use separators, such as distillation columns, flash vessels, absorber columns, and the like, to separate a mixed feed into heavier and lighter fractions. For example, in a distillation column, the mixed feed may be separated into an overhead (light/vapor) fraction and a bottoms (heavy/liquid) fraction, where it is desired to separate a key component from other components in the mixture. The distillation column is operated so as to strip or distill the key component from the remaining components, obtaining overheads and bottoms fractions either "enriched" or "depleted" in the key component. One skilled in the art would recognize that the terms "enriched" and "depleted" refer to the desired separation of the key from the light or heavy fractions, and that "depleted" may include non-zero compositions of the key component. Where the feed stream is separated into three or more fractions, such as via a distillation column with a side draw, a fraction of intermediate key component content may also be formed.

In one aspect, embodiments disclosed herein relate to the purification and production of natural gas product streams, including the recovery of $C_{3+}$ components in gas streams containing hydrocarbons, as well as the separation of nitrogen from the $C_1$ and $C_2$ components. $C_{3+}$ components may be removed, for example, to meet hydrocarbon dewpoint temperature requirements, and nitrogen removal may be performed to meet requirements for inert components in natural gas pipeline sales streams.

Natural gas liquids (NGL) may be recovered according to embodiments disclosed herein from field gas, as produced from a well, or gas streams from various petroleum processes. A typical natural gas feed to be processed in accordance with embodiments disclosed herein may contain nitrogen, carbon dioxide, methane, ethane, propane and other $C_{3+}$ components, such as isobutane, normal butanes, pentanes, and the like. In some embodiments, the natural gas stream may include, in approximate mole percentages, 60 to 95% methane, up to about 20% ethane and other $C_2$ components, up to about 10% propane and other $C_3$ components, up to about 5% $C_{4+}$ components, up to about 10% or more nitrogen, and up to about 1% carbon dioxide.

The composition of the natural gas may vary, depending upon the source and any upstream processing. Processes according to embodiments disclosed herein are particularly useful for natural gas sources having a high nitrogen content, such as greater than about 4 mole % nitrogen in some embodiments; greater than 5 mole %, 6 mole %, 7 mole %, 8 mole %, 9 mole %, and 10 mole % in other embodiments. Upstream processing may include, for example, water removal, such as by contacting the natural gas with a molecular sieve system, and carbon dioxide removal, such as via an amine system. Processes according to embodiments disclosed herein may include both "cold" and "warm" nitrogen removal systems, where "warm" systems perform nitrogen removal at temperatures above the freezing point of carbon dioxide, and thus carbon dioxide removal may not be required for such systems.

Natural gas streams meeting both dewpoint and inert composition sales requirements may be produced according to embodiments disclosed herein using an iso-pressure open refrigeration system. In other embodiments, nitrogen gas streams meeting both dewpoint and inert composition sales requirements may be produced according to embodiments disclosed herein using an iso-pressure open refrigeration system including nitrogen removal. The process may run at approximately constant pressures with no intentional reduction in gas pressures through the plant. As mentioned above, the field gas or other gas streams to be processed may be compressed to a moderate pressure, such as about 20 bar to 35 bar (300 to 500 psig), and dried to less than about 1 ppm water, by weight. The gas may then be processed in the iso-pressure open refrigeration system according to embodiments disclosed herein to remove natural gas liquids and inert gases from the natural gas. The processing of natural gas streams using the iso-pressure open refrigeration system according to embodiments disclosed herein, as will be described below, may provide for a highly efficient separation of nitrogen from natural gas streams, far exceeding the efficiency of typical natural gas processing, such as cryogenic separations in series with a nitrogen removal unit.

The natural gas feed, including nitrogen, methane, ethane, and propane and other $C_{3+}$ hydrocarbons, may be fractionated, using one of more distillation and/or absorber columns to form a natural gas liquids fraction (primarily $C_{3+}$ hydrocarbons), a mixed refrigerant (primarily $C_1$ and $C_2$ hydrocarbons) and a nitrogen-enriched fraction. The mixed refrigerant generated by the separations may also be used as a heat exchange medium, providing at least a portion of the heat exchange duty for the desired separation of the natural gas feed.

In some embodiments, at least a portion of the mixed refrigerant may be used for pipeline sales, containing 4% or less nitrogen and other inert components. In other embodiments, at least a portion of the mixed refrigerant may be combined with process streams having a nitrogen content greater than 4% to result in a stream suitable for pipeline sales, containing 4% or less nitrogen and other inert components.

In embodiments including a nitrogen removal system, the nitrogen-enriched fraction may be separated in a nitrogen removal system to recover two fractions, including a high btu fraction (less than 15% inert components) and a low btu fraction (greater than 15% inert components). In some embodiments, the nitrogen-enriched fraction may be separated into three fractions, including a high btu fraction (less than 15 mole % inert components), an intermediate btu fraction 15 to 30 mole % inert components), and a low btu fraction (greater than 30 mole % inert components).

In some embodiments, the high btu fraction may contain 4 mole % or less nitrogen, or 4% or less nitrogen and other inert components, suitable for pipeline sales.

In other embodiments, a high btu fraction containing more than 4 mole % nitrogen or nitrogen and inert components may be combined with a portion of the mixed refrigerant to form a natural gas composition suitable for pipeline sales. Other low-nitrogen content streams produced in the process may also be combined with the high btu fraction to produce a natural gas suitable for pipeline sales. For example, the process conditions may be adjusted so that the mixed refrigerant contains essentially no nitrogen, and includes primarily methane and ethane. A surprisingly high amount of natural gas, low in nitrogen, may be withdrawn from the mixed refrigerant system at very little incremental processing cost. Thus, due to the extremely low nitrogen content of the natural gas withdrawn, the nitrogen-enriched fraction may be processed with a lower degree of nitrogen separation required. Thus, embodiments disclosed herein may require considerably fewer processing steps as compared to conventional cryogenic processing to remove nitrogen. Further, embodiments disclosed herein may substantially reduce the power required to remove nitrogen from natural gas streams.

In some embodiments disclosed herein, a natural gas feed, for example, including nitrogen, methane, ethane, and propane and other $C_{3+}$ hydrocarbons, may be fractionated into at least two fractions, including a light fraction comprising nitrogen, methane, ethane, and propane, and a heavy fraction, including propane and other $C_{3+}$ hydrocarbons. The fractionation may be performed, for example, in a single distillation column to separate the lighter hydrocarbons and heavier hydrocarbons.

The light fraction may then be separated into at least two fractions, including a nitrogen-enriched fraction and a nitrogen-depleted fraction, such as in a flash drum, a distillation column, or an absorber column.

The nitrogen-depleted fraction may then be separated to recover additional natural gas liquids, such as propane, and to form a mixed refrigerant, including methane and ethane, for example. The nitrogen-depleted fraction may be separated in a flash drum, distillation column, or other separation devices to form a propane-enriched fraction, allowing for recovery of additional natural gas liquids, and a propane-depleted fraction, which may be used as a mixed refrigerant in the process, as will be described below. The propane-enriched fraction may then be recycled to the distillation column for fractionating the natural gas liquids from the gas feed. In some embodiments, the propane-enriched fraction may be used as reflux for the distillation column.

The nitrogen-enriched fraction, including methane, propane, and nitrogen, may then be fed to a nitrogen removal system. For example, in some embodiments, the nitrogen removal system may include a membrane separation system. In some embodiments, the membrane separation system is a warm system, compatible with carbon dioxide. Other nitrogen removal systems may also be used, including cryogenic systems, pressure swing adsorption systems, absorption systems, and other processes for the separation of nitrogen and light hydrocarbons.

The membrane nitrogen removal unit may include a rubbery membrane where methane and ethane selectively permeate through the membrane, leaving a stream concentrated in nitrogen on the high pressure side. The membrane nitrogen removal unit may have several different configurations and may have internal compression requirements to achieve a high degree of separation. The membrane nitrogen removal unit may separate the nitrogen-enriched fraction feed into three streams, including a high btu gas that may be blended with a portion of the mixed refrigerant to produce sales gas, a medium btu gas that may be used for fuel or recycled internally within the nitrogen removal system for further processing, and a low btu gas that has a high nitrogen content, such as greater than 30 or 40 mole percent nitrogen. Because the mixed refrigerant exceeds the nitrogen specification, the high btu stream from the membrane nitrogen removal unit may contain a greater than pipeline specification amount of nitrogen, thus relaxing the separation requirements within the nitrogen removal system. The low nitrogen mixed refrigerant and the high btu gas from the membrane nitrogen removal unit may be compressed and combined, meeting the 4 mole percent nitrogen specification for pipeline sales.

As described above, the processes disclosed herein use an open loop mixed refrigerant process to achieve the low temperatures necessary for high levels of NGL recovery. A single distillation column may be utilized to separate heavier hydrocarbons from lighter components. The overhead stream from the distillation column is cooled to partially liquefy the overhead stream. The partially liquefied overhead stream is separated into a vapor stream comprising lighter components, and a liquid component that serves as a mixed refrigerant. The mixed refrigerant provides process cooling and a portion of the mixed refrigerant is used as a reflux stream to enrich the distillation column with key components. With the gas in the distillation column enriched, the overhead stream of the distillation column condenses at warmer temperatures and the distillation column runs at warmer temperatures than typically used for high recoveries of NGLs. The process achieves high recovery of desired NGL components without expanding the gas as in a Joule-Thompson valve or turbo expander based plant, and with only a single distillation column.

Compared to using turbo expanders for natural gas liquids recovery and standard nitrogen removal systems, the iso-pressure open refrigeration with nitrogen removal system as described herein may reduce the required membrane area and power consumption related to nitrogen removal. In some embodiments, membrane area may be reduced by up to 75 percent or more, and power consumption may be reduced by up to 58 percent or more.

As mentioned above, the mixed refrigerant may provide process cooling to achieve the temperatures required for high recovery of NGL gases. The mixed refrigerant may include a mixture of the lighter and heavier hydrocarbons in the feed gas, and in some embodiments is enriched in the lighter hydrocarbons as compared to the feed gas.

Processes disclosed herein may be used to obtain high levels of propane recovery. In some embodiments, as much as 99 percent or more of the propane in the feed may be recovered in the process, separate from the natural gas recovered for pipeline sales (sales gas). The process may also be operated in a manner to recover significant amounts of ethane with the propane or reject most of the ethane with the natural gas recovered for pipeline sales. Alternatively, the process can be operated to recover a high percentage of $C_{4+}$ components of the feed stream and discharge $C_3$ and lighter components with the sales gas.

Referring now to FIG. 1, a simplified flow diagram of a process for nitrogen removal with iso-pressure open refrigeration natural gas liquids recovery according to embodiments disclosed herein is illustrated. It should be understood that the operating parameters for the process, such as the temperature, pressure, flow rates and compositions of the various streams, are established to achieve the desired separation and recovery of the NGLs. The required operating parameters also depend on the composition of the feed gas. The required operating parameters can be readily determined by those skilled in the art using known techniques, including for example computer simulations.

Feed gas is fed through line 12 to main heat exchanger 10. Although a multi-pass heat exchanger is illustrated, use of multiple heat exchangers may be used to achieve similar results. The feed gas may be natural gas, refinery gas or other gas stream requiring separation. The feed gas is typically filtered and dehydrated prior to being fed into the plant to prevent freezing in the NGL unit. The feed gas is typically fed to the main heat exchanger at a temperature between about 43° C. and 54° C. (110° F. and 130° F.) and at a pressure between about 7 bar and 31 bar (100 psia and 450 psia). The feed gas is cooled and partially liquefied in the main heat exchanger 10 via indirect heat exchange with cooler process streams and/or with a refrigerant which may be fed to the main heat exchanger via line 15 in an amount necessary to provide additional cooling necessary for the process. A warm refrigerant such as propane, for example, may be used to provide the necessary cooling for the feed gas. The feed gas may be cooled in the main heat exchanger to a temperature between about −18° C. and −40° C. (0° F. and −40° F.).

The cool feed gas exits the main heat exchanger 10 and is fed to distillation column 20 via feed line 13. Distillation column 20 operates at a pressure slightly below the pressure of the feed gas, typically at a pressure about 0.3 to 0.7 bar (5 to 10 psi) less than the pressure of the feed gas. In the distillation column, heavier hydrocarbons, such as propane and other $C_{3+}$ components, are separated from the lighter hydrocarbons, such as ethane, methane and other gases. The heavier hydrocarbon components exit in the liquid bottoms from the distillation column through line 16, while the lighter components exit through vapor overhead line 14. In some embodiments, the bottoms stream 16 exits the distillation column at a temperature between about 65° C. and 149° C. (150° F. and 300° F.), and the overhead stream 14 exits the distillation column at a temperature of between about −23° C. and −62° C. (−10° F. and −80° F.).

The bottoms stream 16 from the distillation column is split, with a product stream 18 and a reboil stream 22 directed to a reboiler 30. Optionally, the product stream 18 may be cooled in a cooler (not shown) to a temperature between about 15° C. and 54° C. (60° F. and 130° F.). The product stream 18 is highly enriched in the heavier hydrocarbons in the feed gas stream. In the embodiment shown in FIG. 1, the product stream may be enriched in propane and heavier components, and ethane and lighter gases are further processed as described below. Alternatively, the plant may be operated such that the product stream is heavily enriched in $C_{4+}$ hydrocarbons, and the propane is removed with the ethane in the sales gas produced. The reboil stream 22 is heated in reboiler 30 to provide heat to the distillation column. Any type of reboiler typically used for distillation columns may be used.

The distillation column overhead stream 14 passes through main heat exchanger 10, where it is cooled by indirect heat exchange with process gases to at least partially liquefy or completely (100%) liquefy the stream. The distillation column overhead stream exits the main heat exchanger 10 through line 19 and is cooled sufficiently to produce the mixed refrigerant as described below. In some embodiments, the distillation column overhead stream is cooled to between about −34° C. and −90° C. (−30° F. and −130° F.) in main heat exchanger 10.

The cooled and partially liquefied stream 19 and the overhead stream 28 (stream 32 following control valve 75) from reflux separator 40 may be fed to distillation column overhead separator 60.

The components in distillation column overhead stream 19 and reflux drum overhead stream 32 are separated in overhead separator 60 into an overhead stream 42, a side draw fraction 51, and a bottoms stream 34. The overhead stream 42 from distillation column overhead separator 60 contains methane, ethane, nitrogen, and other lighter components, and is enriched in nitrogen content. Side draw fraction 51 may be of intermediate nitrogen content. The bottoms stream 34 from distillation column overhead separator 60 is the liquid mixed refrigerant used for cooling in the main heat exchanger 10, which may be depleted in nitrogen content. The side draw fraction may be reduced in pressure across flow valve 95, fed to heat exchanger 10 for use in the integrated heat exchange system, and recovered via flow line 52

The components in overhead stream 42 are fed to main heat exchanger 10 and warmed. In a typical plant, the overhead fraction recovered via stream 42 from overhead separator 60 is at a temperature between about −40° C. and −84° C. (−40° F. and −120° F.) and at a pressure between about 5 bar and 30 bar (85 psia and 435 psia). Following heat exchange in main heat exchanger 10, the overhead fraction recovered from heat exchanger 10 via stream 43 may be at a temperature between about 37° C. and 49° C. (100° F. and 120° F.). The overhead fraction is enriched in nitrogen content and may be recovered via stream 43 as a low-btu natural gas stream.

The mixed refrigerant, as mentioned above, is recovered from distillation column overhead separator 60 via bottoms line 34. The temperature of the mixed refrigerant may be lowered by reducing the pressure of the refrigerant across control valve 65. The temperature of the mixed refrigerant is reduced to a temperature cold enough to provide the necessary cooling in the main heat exchanger 10. The mixed refrigerant is fed to the main heat exchanger through line 35. The temperature of the mixed refrigerant entering the main heat exchanger is typically between about −51° C. and −115° C. (−60° F. to −175° F.). Where the control valve 65 is used to reduce the temperature of the mixed refrigerant, the temperature is typically reduced by about 6° C. to 10° C. (20° F. to 50° F.) and the pressure is reduced by about 6 bar to 17 bar (90 to 250 psi). The mixed refrigerant is evaporated and superheated as it passes through the main heat exchanger 10 and exits through line 35*a*. The temperature of the mixed refrigerant exiting the main heat exchanger is between about 26° C. and 38° C. (80° F. and 100° F.).

After exiting main heat exchanger 10, the mixed refrigerant is fed to compressor 80. The mixed refrigerant is compressed to a pressure 1 bar to 2 bar (15 psi to 25 psi) greater than the operating pressure of the distillation column, and at a temperature between about 110° C. to 177° C. (230° F. to 350° F.). By compressing the mixed refrigerant to a pressure greater than the distillation column pressure, there is no need for a reflux pump. The compressed mixed refrigerant flows through line 36 to cooler 90 where it is cooled to a temperature between about 21° C. and 54° C. (70° F. and 130° F.). Optionally, cooler 90 may be omitted and the compressed mixed refrigerant may flow directly to main heat exchanger 10. The compressed mixed refrigerant then flows via line 38 through the main heat exchanger 10 where it is further cooled and partially liquefied. The mixed refrigerant is cooled in the main heat exchanger to a temperature from about −9° C. to −57° C. (15° F. to −70° F.). The partially liquefied mixed refrigerant is introduced through line 39 to reflux separator 40. As described previously, the overheads 28 from reflux separator 40 and overheads 14 from the distillation column 20 are fed to the distillation column overhead separator 60. The liquid bottoms 26 from the reflux separator 40 are fed back to the distillation column 20 as a reflux stream 26. Control valves 75, 85 may be used to hold pressure on the compressor to promote condensation.

The mixed refrigerant used as reflux (fed via stream 26) enriches distillation column 20 with gas phase components. With the gas in the distillation column enriched, the overhead stream of the column condenses at warmer temperatures, and the distillation column runs at warmer temperatures than normally required for a high recovery of NGLs.

The reflux to distillation column 20 also reduces heavier hydrocarbons in the overheads fraction. For example, in processes for recovery of propane, the reflux increases the mole fraction of ethane in the distillation column, which makes it easier to condense the overhead stream. The process uses the liquid condensed in the distillation column overhead separator twice, once as a low temperature refrigerant and the second time as a reflux stream for the distillation column.

At least a portion of the mixed refrigerant in flow line 28, having a very low nitrogen content, may be withdrawn via flow stream 32*ex* prior to separator 60. In some embodiments, the portion withdrawn via flow stream 32*ex* may be used for pipeline sales. In other embodiments, a mixed refrigerant stream 32*ex*, having less than 1 mole % nitrogen, may be mixed with a high or intermediate btu natural gas process stream having greater than 4% nitrogen to result in a pipeline sales stream having 4% or less nitrogen. For example, mixed refrigerant stream 32*ex* may be combined with intermediate btu natural gas in stream 52 (side draw) to result in a natural gas stream suitable for pipeline sales. The flow rates of streams 32*ex* and 52 may be such that the resulting product stream 48 has a nitrogen (inert) content of less than 4 mole %. In some embodiments, flow stream 32*ex* may be fed to main heat exchanger 10; and following heat transfer, the mixed refrigerant may be recovered from heat exchanger 10 via flow line 41 for admixture with intermediate btu stream 52. Other process streams may also be admixed with mixed refrigerant stream 32*ex* in other embodiments.

Processes according to embodiments disclosed herein allow for substantial process flexibility, providing for the ability to efficiently process feed gas streams having a wide range of nitrogen content, as mentioned above. The embodiment described with regard to FIG. 1 allows for recovery of a majority of the feed gas btu value as a natural gas sales stream. Iso-pressure open refrigeration processes according to embodiments disclosed herein may additionally include separation of nitrogen from high or intermediate nitrogen content streams, allowing for additional recovery of btu value or additional flexibility with regard to process conditions and feed gas nitrogen content.

Figure 2:
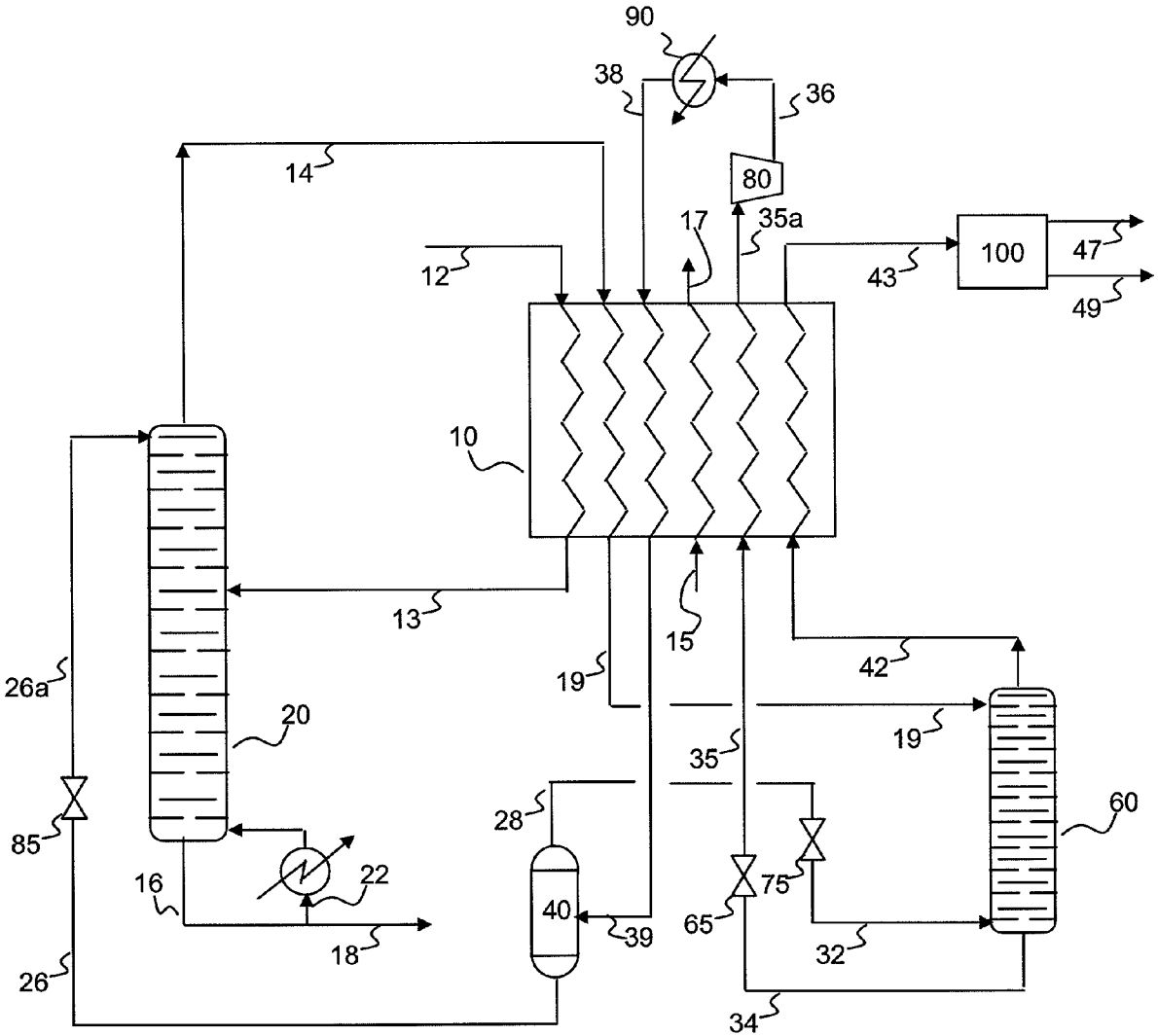
FIG. 2 is a simplified flow diagram of an iso-pressure open refrigeration natural gas liquids recovery process according to embodiments disclosed herein.

Referring now to FIG. 2, a simplified flow diagram of a process for nitrogen removal with iso-pressure open refrigeration natural gas liquids recovery according to embodiments disclosed herein is illustrated, where like numerals represent like parts. It should be understood that the operating parameters for the process, such as the temperature, pressure, flow rates and compositions of the various streams, are established to achieve the desired separation and recovery of the NGLs. The required operating parameters also depend on the composition of the feed gas. The required operating parameters can be readily determined by those skilled in the art using known techniques, including for example computer simulations.

Feed gas is fed through line 12 to main heat exchanger 10. Although a multi-pass heat exchanger is illustrated, use of multiple heat exchangers may be used to achieve similar results. The feed gas may be natural gas, refinery gas or other gas stream requiring separation. The feed gas is typically filtered and dehydrated prior to being fed into the plant to prevent freezing in the NGL unit. The feed gas is typically fed to the main heat exchanger at a temperature between about 43° C. and 54° C. (110° F. and 130° F.) and at a pressure between about 7 bar and 31 bar (100 psia and 450 psia). The feed gas is cooled and partially liquefied in the main heat exchanger 10 via indirect heat exchange with cooler process streams and/or with a refrigerant which may be fed to the main heat exchanger via line 15 in an amount necessary to provide additional cooling necessary for the process. A warm refrigerant such as propane, for example, may be used to provide the necessary cooling for the feed gas. The feed gas may be cooled in the main heat exchanger to a temperature between about −18° C. and −40° C. (0° F. and −40° F.).

The cool feed gas exits the main heat exchanger 10 and is fed to distillation column 20 via feed line 13. Distillation column 20 operates at a pressure slightly below the pressure of the feed gas, typically at a pressure about 0.3 to 0.7 bar (5 to 10 psi) less than the pressure of the feed gas. In the distillation column, heavier hydrocarbons, such as propane and other $C_{3+}$ components, are separated from the lighter hydrocarbons, such as ethane, methane and other gases. The heavier hydrocarbon components exit in the liquid bottoms from the distillation column through line 16, while the lighter components exit through vapor overhead line 14. In some embodiments, the bottoms stream 16 exits the distillation column at a temperature between about 65° C. and 149° C. (150° F. and 300° F.), and the overhead stream 14 exits the distillation column at a temperature of between about −23° C. and −62° C. (−10° F. and −80° F.).

The bottoms stream 16 from the distillation column is split, with a product stream 18 and a reboil stream 22 directed to a reboiler 30. Optionally, the product stream 18 may be cooled in a cooler (not shown) to a temperature between about 15° C. and 54° C. (60° F. and 130° F.). The product stream 18 is highly enriched in the heavier hydrocarbons in the feed gas stream. In the embodiment shown in FIG. 2, the product stream may be enriched in propane and heavier components, and ethane and lighter gases are further processed as described below. Alternatively, the plant may be operated such that the product stream is heavily enriched in $C_{4+}$ hydrocarbons, and the propane is removed with the ethane in the sales gas produced. The reboil stream 22 is heated in reboiler 30 to provide heat to the distillation column. Any type of reboiler typically used for distillation columns may be used.

The distillation column overhead stream 14 passes through main heat exchanger 10, where it is cooled by indirect heat exchange with process gases to partially or wholly (100%) liquefy the stream. The distillation column overhead stream exits the main heat exchanger 10 through line 19 and is cooled sufficiently to produce the mixed refrigerant as described below. In some embodiments, the distillation column overhead stream is cooled to between about −34° C. and −90° C. (−30° F. and −130° F.) in main heat exchanger 10.

The cooled and partially liquefied stream 19 may be combined with the overhead stream 28 (stream 32 following control valve 75) from reflux separator 40 and fed to the distillation column overhead separator 60. Alternatively, stream 19 may be fed to the distillation column overhead separator 60 without being combined with the overhead stream 28 (32) from reflux separator 40, as illustrated in FIG. 2.

The components in distillation column overhead stream 19 and reflux drum overhead stream 32 are separated in overhead separator 60 into an overhead stream 42 and a bottoms stream 34. The overhead stream 42 from distillation column overhead separator 60 contains methane, ethane, nitrogen, and other lighter components. The bottoms stream 34 from distillation column overhead separator 60 is the liquid mixed refrigerant used for cooling in the main heat exchanger 10.

The components in overhead stream 42 are fed to main heat exchanger 10 and warmed. In a typical plant, the overhead fraction recovered via stream 42 from overhead separator 60 is at a temperature between about −40° C. and −84° C. (−40° F. and −120° F.) and at a pressure between about 5 bar and 30 bar (85 psia and 435 psia). Following heat exchange in main heat exchanger 10, the overhead fraction recovered from heat exchanger 10 via stream 43 may be at a temperature between about 37° C. and 49° C. (100° F. and 120° F.). The overhead fraction is sent for further processing via line 43 to a nitrogen removal system 100.

The mixed refrigerant, as mentioned above, is recovered from distillation column overhead separator 60 via bottoms line 34. The temperature of the mixed refrigerant may be lowered by reducing the pressure of the refrigerant across control valve 65. The temperature of the mixed refrigerant is reduced to a temperature cold enough to provide the necessary cooling in the main heat exchanger 10. The mixed refrigerant is fed to the main heat exchanger through line 35. The temperature of the mixed refrigerant entering the main heat exchanger is typically between about −51° C. and −115° C. (−60° F. to −175° F.). Where the control valve 65 is used to reduce the temperature of the mixed refrigerant, the temperature is typically reduced by about 6° C. to 10° C. (20° F. to 50° F.) and the pressure is reduced by about 6 bar to 17 bar (90 to 250 psi). The mixed refrigerant is evaporated and superheated as it passes through the main heat exchanger 10 and exits through line 35*a*. The temperature of the mixed refrigerant exiting the main heat exchanger is between about 26° C. and 38° C. (80° F. and 100° F.).

After exiting main heat exchanger 10, the mixed refrigerant is fed to compressor 80. The mixed refrigerant is compressed to a pressure 1 bar to 2 bar (15 psi to 25 psi) greater than the operating pressure of the distillation column, and at a temperature between about 110° C. to 177° C. (230° F. to 350° F.). By compressing the mixed refrigerant to a pressure greater than the distillation column pressure, there is no need for a reflux pump. The compressed mixed refrigerant flows through line 36 to cooler 90 where it is cooled to a temperature between about 21° C. and 54° C. (70° F. and 130° F.). Optionally, cooler 90 may be omitted and the compressed mixed refrigerant may flow directly to main heat exchanger 10. The compressed mixed refrigerant then flows via line 38 through the main heat exchanger 10 where it is further cooled and partially liquefied. The mixed refrigerant is cooled in the main heat exchanger to a temperature from about −9° C. to −57° C. (15° F. to −70° F.). The partially liquefied mixed refrigerant is introduced through line 39 to reflux separator 40. As described previously, the overheads 28 from reflux separator 40 and overheads 14 from the distillation column 20 are fed to the distillation column overhead separator 60. The liquid bottoms 26 from the reflux separator 40 are fed back to the distillation column 20 as a reflux stream 26. Control valves 75, 85 may be used to hold pressure on the compressor to promote condensation.

The mixed refrigerant used as reflux enriches distillation column 20 with gas phase components. With the gas in the distillation column enriched, the overhead stream of the column condenses at warmer temperatures, and the distillation column runs at warmer temperatures than normally required for a high recovery of NGLs.

The reflux to distillation column 20 also reduces heavier hydrocarbons in the overheads fraction. For example, in processes for recovery of propane, the reflux increases the mole fraction of ethane in the distillation column, which makes it easier to condense the overhead stream. The process uses the liquid condensed in the distillation column overhead separator twice, once as a low temperature refrigerant and the second time as a reflux stream for the distillation column.

As mentioned above, the overhead fraction from separator 60, containing methane, ethane, nitrogen, and other lighter components, is fed via line 43 to a nitrogen removal system 100. Nitrogen removal unit 100 may be used to concentrate the nitrogen in one or more fractions. For example, nitrogen removal unit 100, such as a membrane separation unit, may be used to produce a nitrogen-depleted natural gas fraction 47 and a nitrogen-enriched natural gas fraction 49. In some embodiments, nitrogen-depleted natural gas fraction may have a nitrogen (inert) content of less than 4 mole percent.

Figure 3:
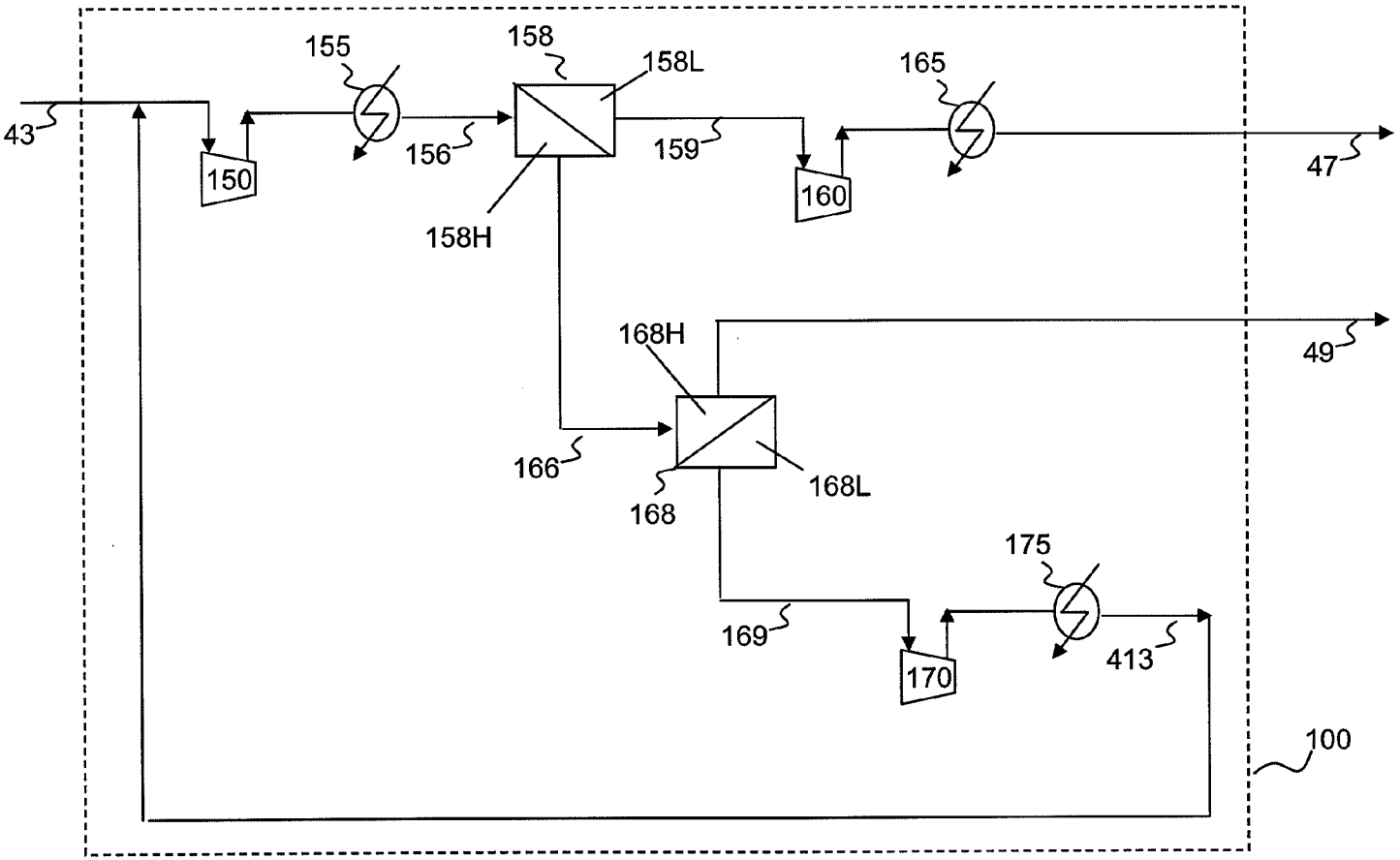
FIG. 3 is a simplified flow diagram of a nitrogen recovery unit of an iso-pressure open refrigeration natural gas liquids recovery process according to embodiments disclosed herein.

Referring now to FIG. 3, one possible embodiment for nitrogen separation unit 100 is illustrated, where like numerals represent like parts. In this embodiment, nitrogen-containing stream 43 is fed to a first compression stage, including compressor 150 and aftercooler 155. The compressed and cooled components in flow line 156, including methane, ethane, nitrogen, and other lighter components, may then be contacted with a membrane separation device 158, including a rubbery membrane allowing methane and ethane to selectively permeate through the membrane, concentrating nitrogen on the high pressure side 158H. A nitrogen-depleted natural gas fraction may be recovered from low pressure side 158L via flow line 159. The nitrogen-deleted natural gas fraction may then be fed via flow line 159 to a second compression stage, including compressor 160 and aftercooler 165, resulting in a compressed and cooled nitrogen-depleted natural gas fraction which may be recovered via flow line 47, as mentioned above.

A nitrogen-enriched fraction may be recovered from high pressure side 158H and fed via flow line 166 to a second membrane separation device 168, also including a rubbery membrane allowing methane and ethane to selectively permeate through the membrane, concentrating nitrogen on high pressure side 168H. A natural gas fraction, such as a low btu fraction may be recovered from high pressure side 168H via flow line 49. A nitrogen-depleted fraction may be recovered from low pressure side 168L via flow line 169 and fed to a compression stage, including a compressor 170 and an aftercooler 175, resulting in a compressed nitrogen-depleted fraction 413, which may be recycled upstream of the first membrane separation unit 158 to recover additional light hydrocarbons.

The degree of separations achieved in nitrogen separation unit 100 may vary depending upon the flow scheme used. For example, a feed gas 43 containing approximately 8 mole percent nitrogen may be fed to membrane separation unit 158. Following separations, a nitrogen-depleted natural gas fraction (a high btu fraction) containing approximately 4 mole % or less nitrogen may be recovered via flow line 47, and a nitrogen-enriched fraction (a low btu fraction) as compared to the feed gas in line 43 may be recovered via flow line 49, containing approximately 40 mole % or more nitrogen. In this example, the nitrogen-depleted natural gas fraction recovered via flow line 47 may be used directly as a sales gas, containing less than 4 mole % nitrogen.

As another example, a feed gas 43 containing approximately 18 mole percent nitrogen may be fed to membrane separation unit 158. Following separations, a nitrogen-depleted natural gas fraction (a high btu fraction) containing approximately 10 mole % or less nitrogen may be recovered via flow line 47, and a nitrogen-enriched fraction (a low btu fraction) as compared to the feed gas in line 43 may be recovered via flow line 49, containing approximately 40 mole % or more nitrogen. In this example, the nitrogen-depleted natural gas fraction recovered via flow line 47 may be diluted with methane and ethane, such as from refrigerant stream 32, to result in a natural gas product stream suitable for use as a sales gas, containing less than 4 mole % nitrogen.

Figure 4:
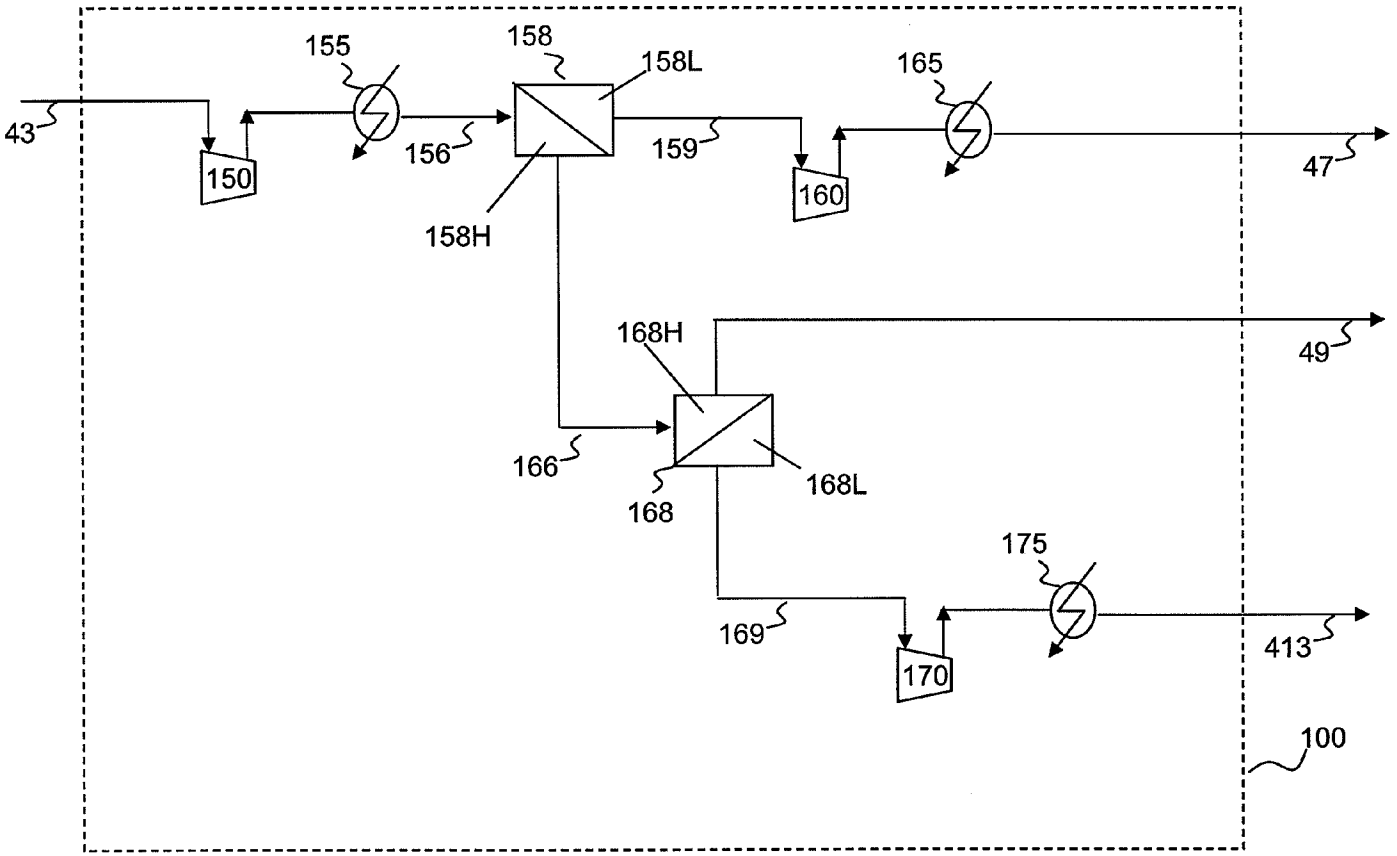
FIG. 4 is a simplified flow diagram of a nitrogen recovery unit of an iso-pressure open refrigeration natural gas liquids recovery process according to embodiments disclosed herein.

Referring now to FIG. 4, where like numerals represent like parts, a second option for membrane nitrogen separation unit 100 is illustrated. In this embodiment, nitrogen-enriched fraction 413 is not recycled, resulting in the production of a high btu stream (stream 47), an low btu stream (stream 49), and an intermediate btu stream (stream 413), each recovered from membrane nitrogen separation unit 100.

Figure 5:
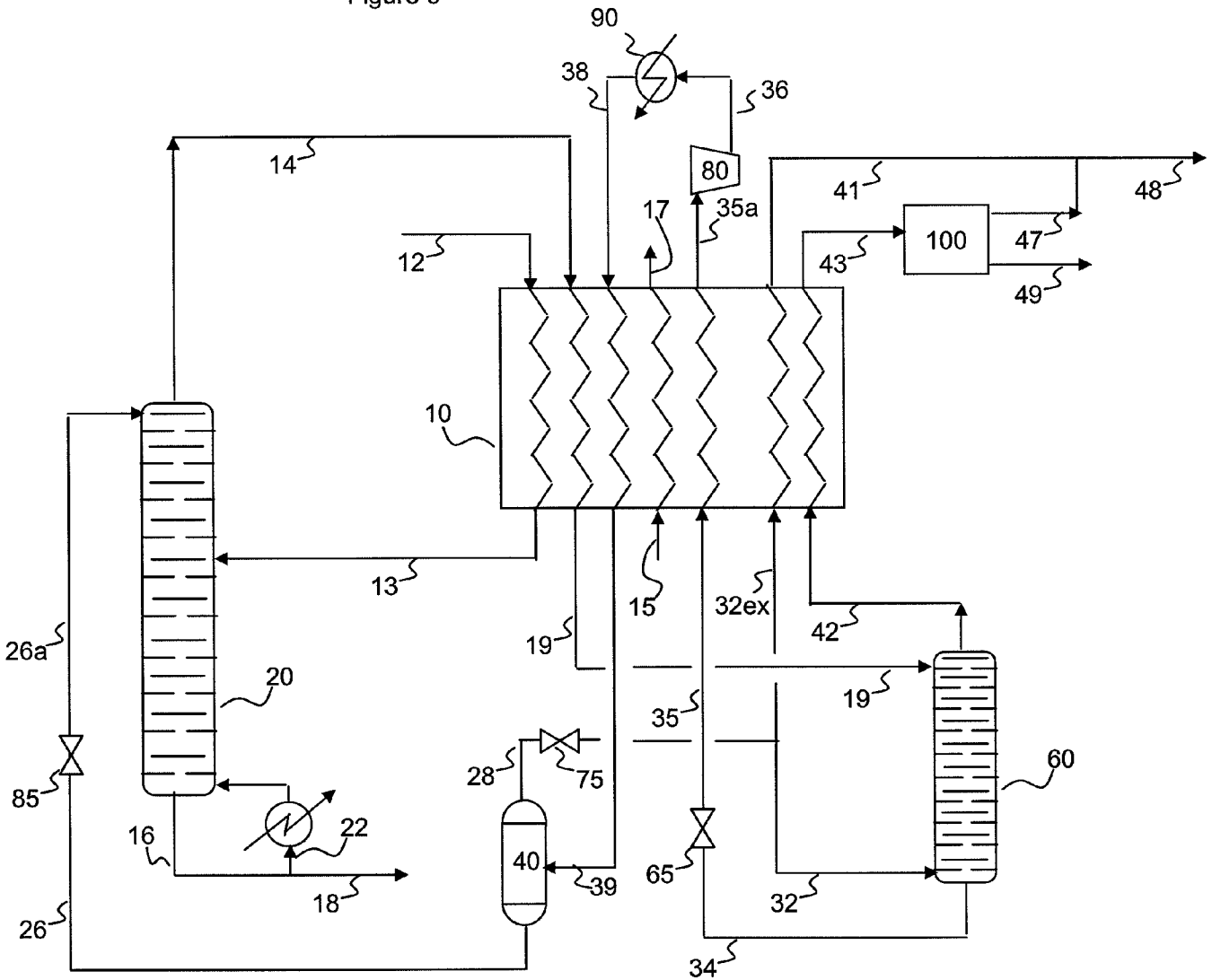
FIG. 5 is a simplified flow diagram of an iso-pressure open refrigeration natural gas liquids recovery process according to embodiments disclosed herein.

Referring now to FIG. 5, a simplified flow diagram of a process for nitrogen removal with iso-pressure open refrigeration natural gas liquids recovery according to embodiments disclosed herein is illustrated, where like numerals represent like parts. In this embodiment, a portion of the mixed refrigerant in flow line 28, having a very low nitrogen content, may be fed via flow line 32*ex* and combined with high btu stream 47 to result in a natural gas product meeting inert gas component requirements. For example, a mixed refrigerant stream 32*ex*, having less than 1 mole % nitrogen, may be mixed with a high btu natural gas product stream 47 from nitrogen removal unit 100, having greater than 4% nitrogen. The flow rates of streams 32*ex* and 47 may be such that the resulting product stream 48 has a nitrogen (inert) content of less than 4 mole %. In some embodiments, flow stream 32*ex* may be fed to main heat exchanger 10; following heat transfer, the mixed refrigerant may be recovered from heat exchanger 10 via flow line 41 for admixture with high btu stream 47.

Figure 6:
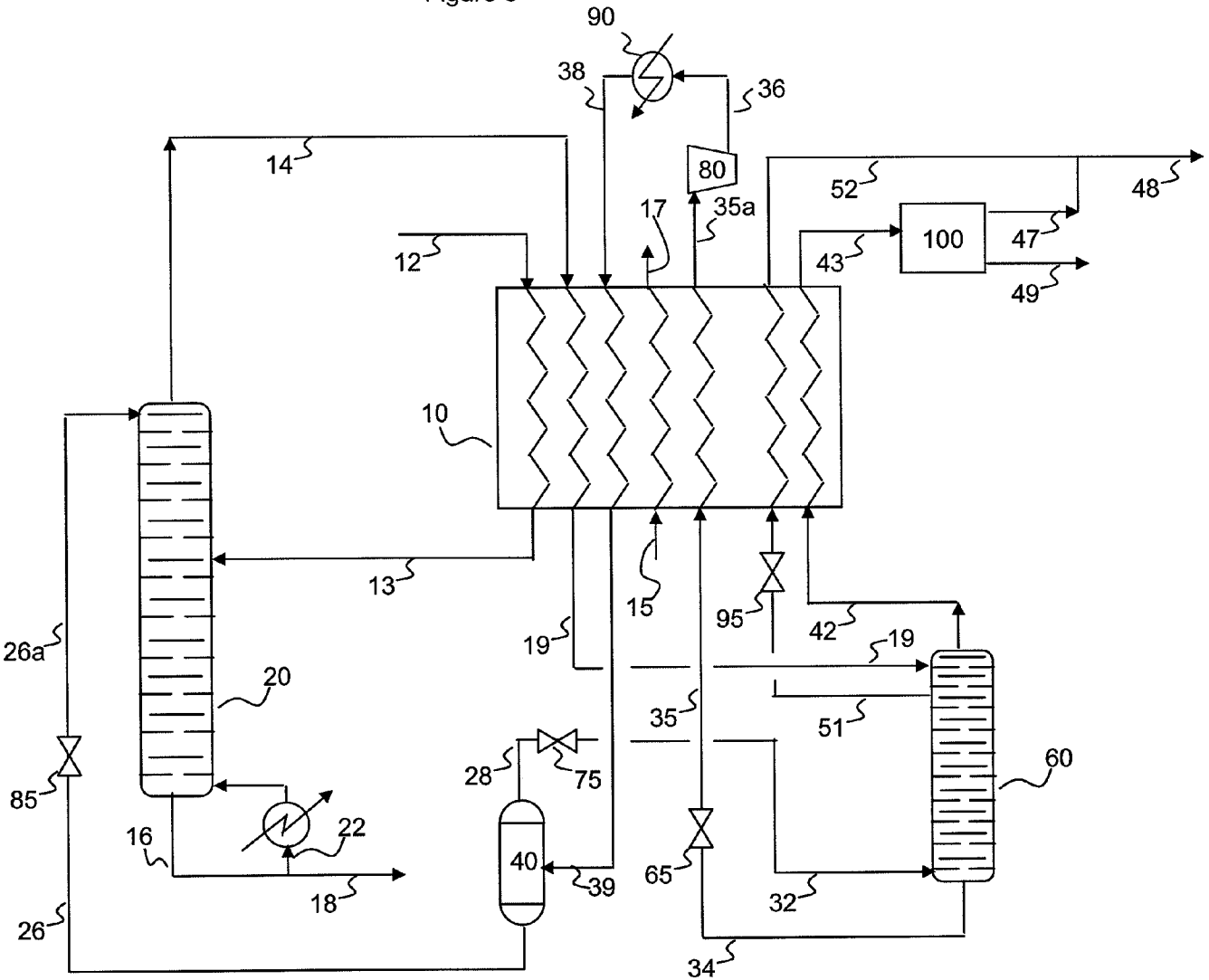
FIG. 6 is a simplified flow diagram of an iso-pressure open refrigeration natural gas liquids recovery process according to embodiments disclosed herein.

Referring now to FIG. 6, a simplified flow diagram of a process for nitrogen removal with iso-pressure open refrigeration natural gas liquids recovery according to embodiments disclosed herein is illustrated, where like numerals represent like parts. As for FIG. 2, mixed refrigerant 28 is reduced in pressure across pressure control valve 75 and fed to separator 60 via flow line 32, as described above for FIG. 2. In this embodiment, separator 60 may be used to separate overhead fraction 14 and mixed refrigerant 28 into three fractions. An overheads fraction enriched in nitrogen and deplete in propane may be recovered from separator 60 via flow line 42 for processing in nitrogen separation unit 100. A bottoms fraction, depleted in nitrogen and enriched in propane may be recovered from separator 60 via flow line 34. As the third fraction, a fraction of intermediate propane and nitrogen may be recovered as a side draw via flow line 51. The side draw fraction may then be reduced in pressure across flow valve 95, fed to heat exchanger 10 for use in the integrated heat exchange system, and fed via flow line 52 for admixture with high btu stream 47, resulting in a natural gas product stream 48 having a nitrogen (inert) composition suitable for use in pipeline sales (i.e., less than 4 mole % nitrogen/inerts).

Figure 7:
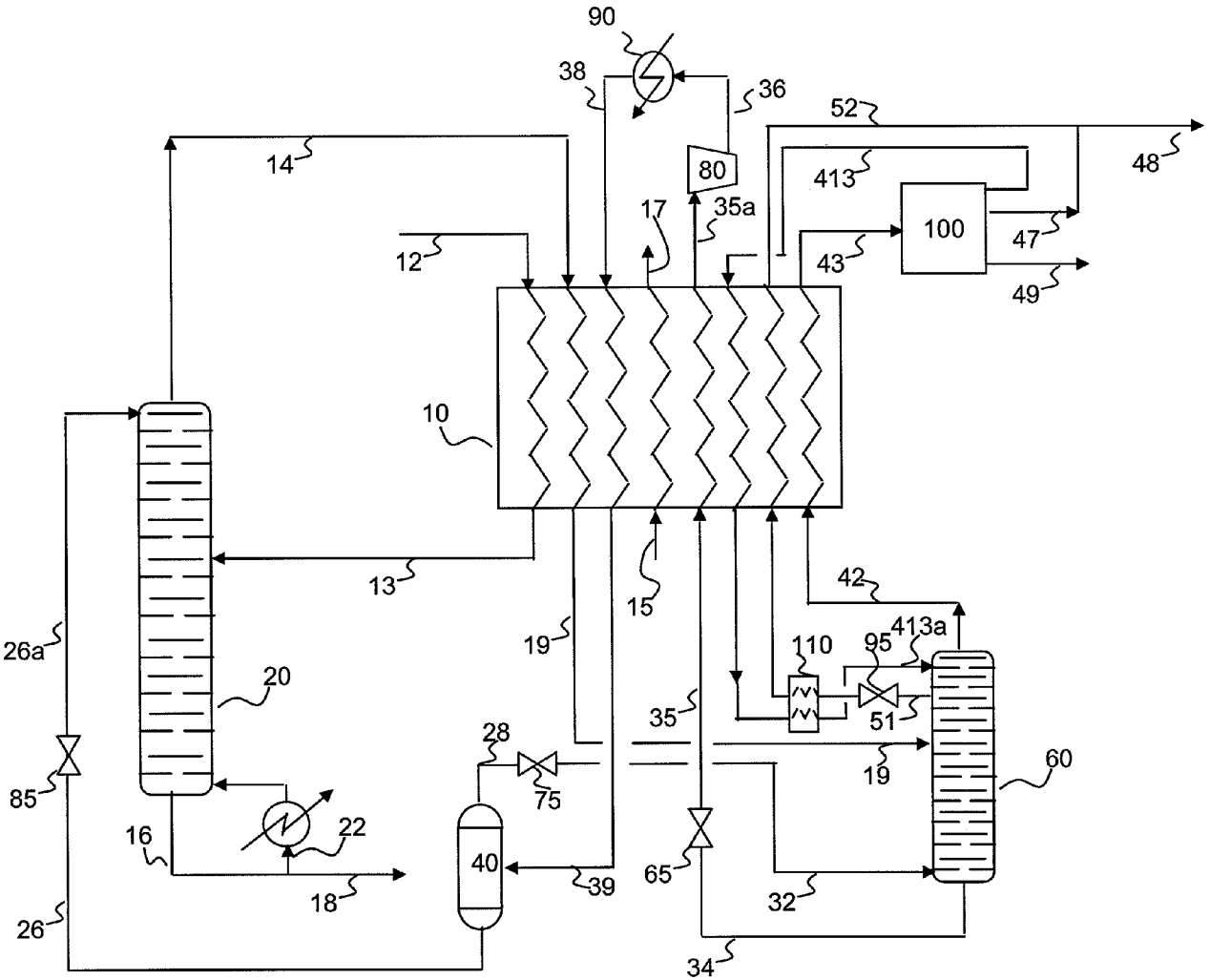
FIG. 7 is a simplified flow diagram of an iso-pressure open refrigeration natural gas liquids recovery process according to embodiments disclosed herein.

Referring now to FIG. 7, a simplified flow diagram of a process for nitrogen removal with iso-pressure open refrigeration natural gas liquids recovery according to embodiments disclosed herein is illustrated, where like numerals represent like parts. The majority of the flow scheme is similar to that described for FIGS. 1 and 5, including side draw 51. Additionally, nitrogen separation unit 100 is as illustrated and described in relation to FIG. 4. In this embodiment, intermediate btu gas stream 413 may be recycled to separator 60 for additional separation and recovery of nitrogen and light hydrocarbons. During recycle, heat may be exchanged with intermediate btu gas stream 413 in heat exchanger 10 and, if desired, additional heat may be exchanged with side draw 51 in heat exchanger 110, resulting in a cooled recycle 413A fed to separator 60.

EXAMPLES

The following examples are derived from modeling techniques. Although the work has been performed, the Inventors do not present these examples in the past tense to comply with applicable rules.

Example 1

A process flow scheme similar to that illustrated in FIG. 1 is simulated. A gas feed having a composition as shown in Table 1 is fed to the process for nitrogen removal with iso-pressure open refrigeration natural gas liquids recovery. The feed rate of the feed gas is set at 11,022 kg/h (24,300 lb/h) at a temperature of 49° C. (120° F.) and a pressure of 29 bar (415 psig). The gas feed is then processed as illustrated in FIG. 1 to result in a high btu (mixed refrigerant) stream 41, an intermediate btu stream 52, and a low btu stream 43. The results of the simulation are presented in Table 1

Key parameters are controlled in the simulation. Primary refrigeration from stream 15 is set up to cool and/or partially condense the feed and mixed refrigerant, refrigerant temperature can be adjusted to optimize heat transfer and power requirements. Reboiler heat is adjusted to control the ethane to propane ratio or other NGL product specification. The pressure and temperature of stream 35 are key parameters. This is the main control parameter for the low temperature mixed refrigerant. When the pressure of stream 35 is lowered, the corresponding temperature decreases, the temperature of stream 19 decreases, and the amount of mixed refrigerant increases. This stream 35 pressure parameter therefore varies reflux to distillation column 20, changing the purity of the overhead stream. The pressure, temperature and flow of stream 35 are also adjusted to satisfy heat transfer requirements in the main heat exchanger 10.

TABLE 1

| Stream | 12 | 13 | 15 | 17 | 14 | 18 | 19 | 34 | 35 |
|---|---|---|---|---|---|---|---|---|---|
| Temperature (° C.) | 48.9 | −31.7 | −34.4 | −34.3 | −36.3 | 106.9 | −98.1 | −90.4 | −106.4 |
| Temperature (° F.) | 120 | −25 | −30 | −29.68 | −33.27 | 224.5 | −144.6 | −130.8 | −159.5 |
| Pressure (bar) | 28.6 | 28.3 | 1.5 | 1.4 | 27.9 | 28.3 | 27.6 | 27.6 | 15.4 |
| Pressure (psia) | 415 | 410 | 21.88 | 20.88 | 405 | 410 | 400 | 400 | 222.7 |
| Mass Flow Rate (kg/h) | 11022 | 11022 | 9834 | 9834 | 9761 | 2816 | 9761 | 8782 | 8782 |
| Mass Flow Rate (lb/h) | 24300 | 24300 | 21680 | 21680 | 21520 | 6209 | 21520 | 19360 | 19360 |
| Component (Mole %) | | | | | | | | | |
| Methane | 0.7597 | 0.7597 | 0 | 0 | 0.7927 | 0 | 0.7927 | 0.7711 | 0.7711 |
| Ethane | 0.0768 | 0.0768 | 0.0150 | 0.0150 | 0.1126 | 0.0091 | 0.1126 | 0.1566 | 0.1566 |
| Propane | 0.0629 | 0.0629 | 0.9800 | 0.9800 | 0.0486 | 0.4575 | 0.0486 | 0.0622 | 0.0622 |
| i-Butane | 0.0113 | 0.0113 | 0.0050 | 0.0050 | 0 | 0.1094 | 0 | 0 | 0 |
| n-Butane | 0.0270 | 0.0270 | 0 | 0 | 0 | 0.2613 | 0 | 0 | 0 |
| i-Pentane | 0.0065 | 0.0065 | 0 | 0 | 0 | 0.0629 | 0 | 0 | 0 |
| n-Pentane | 0.0066 | 0.0066 | 0 | 0 | 0 | 0.0639 | 0 | 0 | 0 |
| n-Heptane | 0.0037 | 0.0037 | 0 | 0 | 0 | 0.0358 | 0 | 0 | 0 |
| Carbon Dioxide | 0.0025 | 0.0025 | 0 | 0 | 0.0029 | 0 | 0.0029 | 0.0041 | 0.0041 |
| Nitrogen | 0.0430 | 0.0430 | 0 | 0 | 0.0430 | 0 | 0.0430 | 0.0060 | 0.0060 |

| Stream | 42 | 43 | 39 | 28 | 26 | 32 | 32ex | 51 | 48 |
|---|---|---|---|---|---|---|---|---|---|
| Temperature (° C.) | −98.4 | 43.3 | −41.1 | −41.1 | −41.1 | −45.3 | −45.3 | −95.8 | 43.1 |
| Temperature (° F.) | −145.1 | 110 | −42 | −42 | −42 | −49.5 | −49.5 | −140.5 | 109.6 |
| Pressure (bar) | 27.2 | 26.9 | 33.4 | 33.4 | 33.4 | 27.9 | 27.9 | 27.5 | 27.2 |

TABLE 1-continued

| | | | | | | | | | |
|---|---|---|---|---|---|---|---|---|---|
| Pressure (psia) | 395 | 390 | 485 | 485 | 485 | 405 | 405 | 399.5 | 394.5 |
| Mass Flow Rate (kg/h) | 533 | 533 | 8782 | 7226 | 1557 | 1999 | 5253 | 2448 | 7702 |
| Mass Flow Rate (lb/h) | 1174 | 1174 | 19360 | 15930 | 3433 | 4408 | 11580 | 5397 | 16980 |
| Component (Mole %) | | | | | | | | | |
| Methane | 0.8267 | 0.8267 | 0.7711 | 0.8316 | 0.3229 | 0.8318 | 0.8318 | 0.8825 | 0.8488 |
| Ethane | 0.0091 | 0.0091 | 0.1566 | 0.1297 | 0.3551 | 0.1292 | 0.1292 | 0.0103 | 0.0895 |
| Propane | 0.0006 | 0.0006 | 0.0622 | 0.0278 | 0.3169 | 0.0279 | 0.0279 | 0.0007 | 0.0188 |
| i-Butane | 0 | 0 | 0 | 0 | 0 | 0 | 0 | 0 | 0 |
| n-Butane | 0 | 0 | 0 | 0 | 0 | 0 | 0 | 0 | 0 |
| i-Pentane | 0 | 0 | 0 | 0 | 0 | 0 | 0 | 0 | 0 |
| n-Pentane | 0 | 0 | 0 | 0 | 0 | 0 | 0 | 0 | 0 |
| n-Heptane | 0 | 0 | 0 | 0 | 0 | 0 | 0 | 0 | 0 |
| Carbon Dioxide | 0.0007 | 0.0007 | 0.0041 | 0.0040 | 0.0043 | 0.0040 | 0.0040 | 0.0008 | 0.0029 |
| Nitrogen | 0.1629 | 0.1629 | 0.0060 | 0.0067 | 0.0008 | 0.0070 | 0.0070 | 0.1057 | 0.0400 |

Examples 2-5

For each of the simulation studies in Examples 2-5, a gas feed having a composition as shown in Table 2 is fed to the process for nitrogen removal with iso-pressure open refrigeration natural gas liquids recovery. The feed rate of the feed gas is set at 11,181 kg/h (24,650 lb/h) at a temperature of 49° C. (120° F.) and a pressure of 29 bar (415 psig).

TABLE 2

| Nitrogen-containing Natural Gas Feed Composition | |
|---|---|
| Component | Mole Fraction |
| Methane | 0.7327 |
| Ethane | 0.0768 |
| Propane | 0.0629 |
| i-Butane | 0.0113 |
| n-Butane | 0.0270 |
| i-Pentane | 0.0065 |
| n-Pentane | 0.0066 |
| n-Heptane | 0.0037 |
| Carbon Dioxide | 0.0025 |
| Nitrogen | 0.0700 |

Example 2

A process flow scheme similar to that illustrated in FIG. 2 is simulated, where the nitrogen separation unit 100 is as illustrated in FIG. 3. Key parameters are controlled in the simulation. Primary refrigeration from stream 15 is set up to cool and/or partially condense the feed and mixed refrigerant, refrigerant temperature can be adjusted to optimize heat transfer and power requirements. Reboiler heat is adjusted to control the ethane to propane ratio or other NGL product specification. The pressure and temperature of stream 35 is a key parameter. This is the main control parameter for the low temperature mixed refrigerant. When the pressure of stream 35 is lowered, the corresponding temperature decreases, the temperature of stream 19 decreases, and the amount of mixed refrigerant increases. This stream 35 pressure parameter therefore varies reflux to distillation column 20, changing the purity of the overhead stream. The pressure, temperature and flow of stream 35 are also adjusted to satisfy heat transfer requirements in the main heat exchanger 10. Nitrogen separation unit 100 is controlled to result in a nitrogen-depleted (high btu) fraction 47 having a nitrogen content of 4 mole % while calculating the required size of the membranes in each separation stage. For membrane sizing, selectivity of the membrane for allowing methane to pass as compared to nitrogen is set at 3 to 1. The results of the simulation are presented in Table 3, and utility requirements and membrane sizing for Examples 2-5 are compared in Table 7.

TABLE 3

| Stream | 12 | 13 | 15 | 17 | 14 | 18 | 19 | 34 |
|---|---|---|---|---|---|---|---|---|
| Temperature (° C.) | 48.9 | −31.7 | −34.4 | −34.3 | −35.2 | 105.7 | −58.3 | −53.0 |
| Temperature (° F.) | 120 | −25 | −30 | −29.68 | −31.29 | 222.3 | −72.95 | −63.42 |
| Pressure (bar) | 28.6 | 28.3 | 1.5 | 1.4 | 27.9 | 28.3 | 27.6 | 27.9 |
| Pressure (psia) | 415 | 410 | 21.88 | 20.88 | 405 | 410 | 400 | 405 |
| Mass Flow Rate (kg/h) | 11181 | 11181 | 9371 | 9371 | 9974 | 2885 | 9974 | 1871 |
| Mass Flow Rate (lb/h) | 24650 | 24650 | 20660 | 20660 | 21990 | 6361 | 21990 | 4124 |
| Component (Mole %) | | | | | | | | |
| Methane | 0.7327 | 0.7327 | 0 | 0 | 0.7589 | 0 | 0.7589 | 0.3267 |
| Ethane | 0.0768 | 0.0768 | 0.0150 | 0.0150 | 0.1171 | 0.0095 | 0.1171 | 0.3566 |
| Propane | 0.0629 | 0.0629 | 0.9800 | 0.9800 | 0.0508 | 0.4730 | 0.0508 | 0.3110 |
| i-Butane | 0.0113 | 0.0113 | 0.0050 | 0.0050 | 0 | 0.1061 | 0 | 0 |
| n-Butane | 0.0270 | 0.0270 | 0 | 0 | 0 | 0.2536 | 0 | 0 |
| i-Pentane | 0.0065 | 0.0065 | 0 | 0 | 0 | 0.0610 | 0 | 0 |
| n-Pentane | 0.0066 | 0.0066 | 0 | 0 | 0 | 0.0620 | 0 | 0 |
| n-Heptane | 0.0037 | 0.0037 | 0 | 0 | 0 | 0.0348 | 0 | 0 |
| Carbon Dioxide | 0.0025 | 0.0025 | 0 | 0 | 0.0030 | 0 | 0.0030 | 0.0043 |
| Nitrogen | 0.0700 | 0.0700 | 0 | 0 | 0.0701 | 0 | 0.0701 | 0.0014 |
| Stream | 35 | 42 | 43 | 39 | 28 | 26 | 47 | 49 |
| Temperature (° C.) | −85.3 | −58.3 | 43.3 | −34.4 | −34.4 | −34.4 | 48.9 | 21.9 |
| Temperature (° F.) | −121.5 | −72.91 | 110 | −30 | −30 | −30 | 120 | 71.34 |

TABLE 3-continued

| | | | | | | | | |
|---|---|---|---|---|---|---|---|---|
| Pressure (bar) | 4.0 | 27.6 | 27.2 | 28.9 | 28.9 | 28.9 | 27.6 | 25.9 |
| Pressure (psia) | 57.65 | 400 | 395 | 420 | 420 | 420 | 400 | 375 |
| Mass Flow Rate (kg/h) | 1871 | 8296 | 8296 | 1871 | 194 | 1676 | 7307 | 990 |
| Mass Flow Rate (lb/h) | 4124 | 18290 | 18290 | 4124 | 427.7 | 3696 | 16110 | 2182 |
| Component (Mole %) | | | | | | | | |
| Methane | 0.3267 | 0.8200 | 0.8200 | 0.3267 | 0.7737 | 0.2437 | 0.8470 | 0.5936 |
| Ethane | 0.3566 | 0.0848 | 0.0848 | 0.3566 | 0.1762 | 0.3901 | 0.0942 | 0.0055 |
| Propane | 0.3110 | 0.0140 | 0.0140 | 0.3110 | 0.0392 | 0.3614 | 0.0156 | 0.0003 |
| i-Butane | 0 | 0 | 0 | 0 | 0 | 0 | 0 | 0 |
| n-Butane | 0 | 0 | 0 | 0 | 0 | 0 | 0 | 0 |
| i-Pentane | 0 | 0 | 0 | 0 | 0 | 0 | 0 | 0 |
| n-Pentane | 0 | 0 | 0 | 0 | 0 | 0 | 0 | 0 |
| n-Heptane | 0 | 0 | 0 | 0 | 0 | 0 | 0 | 0 |
| Carbon Dioxide | 0.0043 | 0.0029 | 0.0029 | 0.0043 | 0.0050 | 0.0042 | 0.0032 | 0.0001 |
| Nitrogen | 0.0014 | 0.0783 | 0.0783 | 0.0014 | 0.0060 | 0.0005 | 0.0400 | 0.4005 |

Example 3

A process flow scheme similar to that illustrated in FIG. 5 is simulated, where the nitrogen separation unit 100 is as illustrated in FIG. 3. Key parameters are controlled in the simulation. Primary refrigeration from stream 15 is set up to cool and or partially condense the feed and mixed refrigerant, refrigerant temperature can be adjusted to optimize heat transfer and power requirements. Reboiler heat is adjusted to control the ethane to propane ratio or other NGL product specification. The pressure and temperature of stream 35 is a key parameter. This is the main control parameter for the low temperature mixed refrigerant. When the pressure of stream 35 is lowered, the corresponding temperature decreases, the temperature of stream 19 decreases, and the amount of mixed refrigerant increases. This stream 35 pressure parameter therefore varies reflux to distillation column 20, changing the purity of the overhead stream. The pressure, temperature and flow of stream 35 are also adjusted to satisfy heat transfer requirements in the main heat exchanger 10. To increase the amount of low nitrogen natural gas available for export in stream 32*ex*, the temperature of stream 35 is lowered causing the mixed refrigerant has an increase in mass flow and methane content allowing excess mixed refrigerant to leave the system in stream 32*ex*. Although stream 35 runs colder it can eventually be at a higher pressure because of the increased methane content. The flow of stream 32 is adjusted to provide stripping gas in the separator 60. Stream 32 is low in nitrogen and strips nitrogen out of the mixed refrigerant source stream 34. Nitrogen separation unit 100 is controlled to result in a nitrogen-enriched (low btu) fraction 49 having a nitrogen content of 40 mole % while calculating the required size of the membranes (also having a 3:1 selectivity). Overall flowsheet calculation control is set to have a natural gas sales stream 48 having a nitrogen content of 4 mole %. The results of the simulation are presented in Table 4, and utility requirements and membrane sizing for Examples 2-5 are compared in Table 7.

TABLE 4

| Stream | 12 | 13 | 15 | 17 | 14 | 18 | 19 | 34 | 42 |
|---|---|---|---|---|---|---|---|---|---|
| Temperature (° C.) | 48.9 | −28.9 | −34.4 | −34.3 | −36.1 | 105.7 | −100.1 | −87.9 | −98.2 |
| Temperature (° F.) | 120 | −20 | −30 | −29.68 | −33.04 | 222.3 | −148.2 | −126.3 | −144.8 |
| Pressure (bar) | 28.6 | 28.3 | 1.5 | 1.4 | 27.9 | 28.3 | 27.6 | 27.6 | 27.2 |
| Pressure (psia) | 415 | 410 | 21.88 | 20.88 | 405 | 410 | 400 | 400 | 395 |
| Mass Flow Rate (kg/h) | 11181 | 11181 | 10437 | 10437 | 10201 | 2887 | 10201 | 8818 | 3646 |
| Mass Flow Rate (lb/h) | 24650 | 24650 | 23010 | 23010 | 22490 | 6365 | 22490 | 19440 | 8039 |
| Component (Mole %) | | | | | | | | | |
| Methane | 0.7327 | 0.7327 | 0 | 0 | 0.7570 | 0 | 0.7570 | 0.7495 | 0.8136 |
| Ethane | 0.0768 | 0.0768 | 0.0150 | 0.0150 | 0.1245 | 0.0095 | 0.1245 | 0.1836 | 0.0103 |
| Propane | 0.0629 | 0.0629 | 0.9800 | 0.9800 | 0.0470 | 0.4734 | 0.0470 | 0.0622 | 0.0006 |
| i-Butane | 0.0113 | 0.0113 | 0.0050 | 0.0050 | 0 | 0.1061 | 0 | 0 | 0 |
| n-Butane | 0.0270 | 0.0270 | 0 | 0 | 0 | 0.2534 | 0 | 0 | 0 |
| i-Pentane | 0.0065 | 0.0065 | 0 | 0 | 0 | 0.0610 | 0 | 0 | 0 |
| n-Pentane | 0.0066 | 0.0066 | 0 | 0 | 0 | 0.0619 | 0 | 0 | 0 |
| n-Heptane | 0.0037 | 0.0037 | 0 | 0 | 0 | 0.0347 | 0 | 0 | 0 |
| Carbon Dioxide | 0.0025 | 0.0025 | 0 | 0 | 0.0031 | 0 | 0.0031 | 0.0045 | 0.0007 |
| Nitrogen | 0.0700 | 0.0700 | 0 | 0 | 0.0684 | 0 | 0.0684 | 0.0002 | 0.1748 |

| Stream | 43 | 35 | 28 | 32 | 32ex | 26 |
|---|---|---|---|---|---|---|
| Temperature (° C.) | 43.3 | −106.4 | −41.1 | −45.4 | −45.4 | −41.1 |
| Temperature (° F.) | 110 | −159.5 | −42 | −49.7 | −49.71 | −42 |
| Pressure (bar) | 26.9 | 14.2 | 33.4 | 27.9 | 27.9 | 33.4 |
| Pressure (psia) | 390 | 206.0 | 485 | 405 | 405 | 485 |
| Mass Flow Rate (kg/h) | 3646 | 8818 | 6894 | 2260 | 4636 | 1906 |
| Mass Flow Rate (lb/h) | 8039 | 19440 | 15200 | 4983 | 10220 | 4202 |
| Component (Mole %) | | | | | | |
| Methane | 0.8136 | 0.7495 | 0.8248 | 0.8248 | 0.8248 | 0.3245 |
| Ethane | 0.0103 | 0.1836 | 0.1459 | 0.1459 | 0.1459 | 0.3964 |
| Propane | 0.0006 | 0.0622 | 0.0246 | 0.0246 | 0.0246 | 0.2743 |

TABLE 4-continued

| | | | | | | |
|---|---|---|---|---|---|---|
| i-Butane | 0 | 0 | 0 | 0 | 0 | 0 |
| n-Butane | 0 | 0 | 0 | 0 | 0 | 0 |
| i-Pentane | 0 | 0 | 0 | 0 | 0 | 0 |
| n-Pentane | 0 | 0 | 0 | 0 | 0 | 0 |
| n-Heptane | 0 | 0 | 0 | 0 | 0 | 0 |
| Carbon Dioxide | 0.0007 | 0.0045 | 0.0045 | 0.0045 | 0.0045 | 0.0048 |
| Nitrogen | 0.1748 | 0.0002 | 0.0002 | 0.0002 | 0.0002 | 0 |

| Stream | 39 | 47 | 49 | 48 |
|---|---|---|---|---|
| Temperature (° C.) | −41.1 | 48.9 | 30.4 | 38 |
| Temperature (° F.) | −42 | 120 | 86.78 | 100.4 |
| Pressure (bar) | 33.4 | 27.6 | 25.9 | 27.6 |
| Pressure (psia) | 485 | 400 | 375 | 400 |
| Mass Flow Rate (kg/h) | 8817 | 2653 | 992 | 7289 |
| Mass Flow Rate (lb/h) | 19440 | 5851 | 2188 | 16070 |
| Component (Mole %) | | | | |
| Methane | 0.7495 | 0.8811 | 0.5988 | 0.8458 |
| Ethane | 0.1836 | 0.0129 | 0.0022 | 0.0957 |
| Propane | 0.0622 | 0.0007 | 0.0001 | 0.0154 |
| i-Butane | 0 | 0 | 0 | 0 |
| n-Butane | 0 | 0 | 0 | 0 |
| i-Pentane | 0 | 0 | 0 | 0 |
| n-Pentane | 0 | 0 | 0 | 0 |
| n-Heptane | 0 | 0 | 0 | 0 |
| Carbon Dioxide | 0.0045 | 0.0009 | 0.0002 | 0.0031 |
| Nitrogen | 0.0002 | 0.1045 | 0.3988 | 0.0400 |

Example 4

A process flow scheme similar to that illustrated in FIG. 6 is simulated, where the nitrogen separation unit 100 is as illustrated in FIG. 3. Key parameters are controlled in the simulation. Primary refrigeration from stream 15 is set up to cool and or partially condense the feed and mixed refrigerant, refrigerant temperature can be adjusted to optimize heat transfer and power requirements. Reboiler heat is adjusted to control the ethane to propane ratio or other NGL product specification. The pressure and temperature of stream 35 is a key parameter. This is the main control parameter for the low temperature mixed refrigerant. When the pressure of stream 35 is lowered, the corresponding temperature decreases, the temperature of stream 19 decreases, and the amount of mixed refrigerant increases. The pressure, temperature and flow of stream 35 are adjusted to satisfy heat transfer requirements in the main heat exchanger 10. To increase the amount of low nitrogen natural gas available for export the temperature of stream 35 is lowered the mixed refrigerant has an increase in mass flow and methane content allowing excess mixed refrigerant to leave the system. Although stream 35 runs colder it can eventually be at a higher pressure because of the increased methane content. As an alternative to removing low nitrogen natural gas in stream 32*ex* liquid natural gas, stream 51 or cold natural gas vapor are withdrawn from the separator 60 at a point in this column where nitrogen is adequately depleted. The temperature and pressure of stream 39 can be fine-tuned to adjust the flow of reflux in stream 26. Increasing reflux steam 26 lowers the amount of heavy key component in the distillation column 60 overhead. Nitrogen separation unit 100 is controlled to result in a nitrogen-enriched (low btu) fraction 49 having a nitrogen content of 40 mole % while calculating the required size of the membranes (also having a 3:1 selectivity). Overall flowsheet calculation control is set to have a natural gas sales stream 48 having a nitrogen content of 4 mole %. The results of the simulation are presented in Table 5, and utility requirements and membrane sizing for Examples 2-5 are compared in Table 7.

TABLE 5

| Stream | 12 | 13 | 15 | 17 | 14 | 18 | 19 | 34 | 42 |
|---|---|---|---|---|---|---|---|---|---|
| Temperature (° C.) | 4.9 | −28.9 | −34.4 | −34.3 | −40.6 | 105.7 | −103.9 | −78.3 | −97.7 |
| Temperature (° F.) | 120 | −20 | −30 | −29.68 | −41.03 | 222.3 | −155.0 | −109 | −143.8 |
| Pressure (bar) | 28.6 | 28.3 | 1.5 | 1.4 | 27.9 | 28.3 | 27.6 | 27.6 | 27.2 |
| Pressure (psia) | 415 | 410 | 21.88 | 20.88 | 405 | 410 | 400 | 400 | 395 |
| Mass Flow Rate (kg/h) | 11181 | 11181 | 9675 | 9675 | 10532 | 2887 | 10532 | 5679 | 3864 |
| Mass Flow Rate (lb/h) | 24650 | 24650 | 21330 | 21330 | 23220 | 6365 | 23220 | 12520 | 8518 |
| Component (Mole %) | | | | | | | | | |
| Methane | 0.7327 | 0.7327 | 0 | 0 | 0.7363 | 0 | 0.7363 | 0.5829 | 0.8222 |
| Ethane | 0.0768 | 0.0768 | 0.0150 | 0.0150 | 0.1632 | 0.0095 | 0.1632 | 0.3581 | 0.0125 |
| Propane | 0.0629 | 0.0629 | 0.9800 | 0.9800 | 0.0295 | 0.4734 | 0.0295 | 0.0447 | 0.0003 |
| i-Butane | 0.0113 | 0.0113 | 0.0050 | 0.0050 | 0 | 0.1060 | 0 | 0 | 0 |
| n-Butane | 0.0270 | 0.0270 | 0 | 0 | 0 | 0.2534 | 0 | 0 | 0 |
| i-Pentane | 0.0065 | 0.0065 | 0 | 0 | 0 | 0.0610 | 0 | 0 | 0 |
| n-Pentane | 0.0066 | 0.0066 | 0 | 0 | 0 | 0.0619 | 0 | 0 | 0 |
| n-Heptane | 0.0037 | 0.0037 | 0 | 0 | 0 | 0.0347 | 0 | 0 | 0 |
| Carbon Dioxide | 0.0025 | 0.0025 | 0 | 0 | 0.0045 | 0 | 0.0045 | 0.0143 | 0.0010 |
| Nitrogen | 0.0700 | 0.0700 | 0 | 0 | 0.0665 | 0 | 0.0665 | 0 | 0.1640 |

TABLE 5-continued

| Stream | 43 | 35 | 51 | 39 | 28 | 26 | 47 | 49 | 48 |
|---|---|---|---|---|---|---|---|---|---|
| Temperature (° C.) | 43.3 | −110.6 | −91.1 | −40 | −40 | −40 | 48.9 | 17.4 | 48.8 |
| Temperature (° F.) | 110 | −167.0 | −131.9 | −40 | −40 | −40 | 120 | 63.24 | 119.8 |
| Pressure (bar) | 26.9 | 7.4 | 27.5 | 29.6 | 29.6 | 29.6 | 27.6 | 64.8 | 27.6 |
| Pressure (psia) | 390 | 106.8 | 398.3 | 430 | 430 | 430 | 400 | 940 | 400 |
| Mass Flow Rate (kg/h) | 3864 | 5679 | 4453 | 5679 | 3440 | 2241 | 2879 | 985 | 7330 |
| Mass Flow Rate (lb/h) | 8518 | 12520 | 9817 | 12520 | 7584 | 4940 | 6348 | 2171 | 16160 |
| Component (Mole %) | | | | | | | | | |
| Methane | 0.8222 | 0.5829 | 0.8186 | 0.5829 | 0.7306 | 0.2668 | 0.8866 | 0.5976 | 0.8467 |
| Ethane | 0.0125 | 0.3581 | 0.1501 | 0.3581 | 0.2436 | 0.6033 | 0.0154 | 0.0025 | 0.0944 |
| Propane | 0.0003 | 0.0447 | 0.0266 | 0.0447 | 0.0155 | 0.1158 | 0.0004 | 0 | 0.0158 |
| i-Butane | 0 | 0 | 0 | 0 | 0 | 0 | 0 | 0 | 0 |
| n-Butane | 0 | 0 | 0 | 0 | 0 | 0 | 0 | 0 | 0 |
| i-Pentane | 0 | 0 | 0 | 0 | 0 | 0 | 0 | 0 | 0 |
| n-Pentane | 0 | 0 | 0 | 0 | 0 | 0 | 0 | 0 | 0 |
| n-Heptane | 0 | 0 | 0 | 0 | 0 | 0 | 0 | 0 | 0 |
| Carbon Dioxide | 0.0010 | 0.0143 | 0.0044 | 0.0143 | 0.0144 | 0.0141 | 0.0012 | 0.0002 | 0.0031 |
| Nitrogen | 0.1640 | 0 | 0.0003 | 0 | 0 | 0 | 0.0964 | 0.3996 | 0.0400 |

Example 5

A process flow scheme similar to that illustrated in FIG. 7 is simulated, where the nitrogen separation unit 100 is as illustrated in FIG. 4. Key parameters are controlled in the simulation. Primary refrigeration from stream 15 is set up to cool and or partially condense the feed and mixed refrigerant, refrigerant temperature can be adjusted to optimize heat transfer and power requirements. Reboiler heat is adjusted to control the ethane to propane ratio or other NGL product specification. The pressure and temperature of stream 35 is a key parameter. This is the main control parameter for the low temperature mixed refrigerant. When the pressure of stream 35 is lowered the corresponding temperature becomes lower, the temperature of stream 19 becomes lower and the amount of mixed refrigerant increases. The pressure, temperature and flow of stream 35 are adjusted to satisfy heat transfer requirements in the main heat exchanger 10. To increase the amount of low nitrogen natural gas available for export the temperature of stream 35 lowered the mixed refrigerant has an increase in mass flow and methane content allowing excess mixed refrigerant to leave the system. Although stream 35 runs colder it can eventually be at a higher pressure because of the increased methane content. Liquid natural gas, stream 51 is withdrawn from the separator 60 at a point in this column where nitrogen is adequately depleted. Stream 51 has a high percentage of liquid methane making it an excellent source of low temperature refrigeration. Lowering the pressure of stream 51 across valve 95 provides a cold refrigeration utility stream for heat exchanger 110 which condenses part of the high nitrogen content stream 413 originating in nitrogen separation unit 100. This recycle consumes the intermediate btu gas stream 413, instead of producing an intermediate btu fuel stream, more sales gas and a low btu nitrogen stream are produced. Adding the 413*a* reflux stream to the separator 60 increases nitrogen-methane separation done by distillation. The temperature and pressure of stream 39 can be fine tuned to adjust the flow of reflux in stream 26. Increasing reflux steam 26 lowers the amount of heavy key component in the distillation column 60 overhead. Nitrogen separation unit 100 is controlled to result in a nitrogen-depleted (high btu) fraction 47 having a nitrogen content of 10 mole % while calculating the required size of the membranes (also having a 3:1 selectivity). Overall flowsheet calculation control is set to have a natural gas sales stream 48 having a nitrogen content of 4 mole %. The results of the simulation are presented in Table 6, and utility requirements and membrane sizing for Examples 2-5 are compared in Table 7.

TABLE 6

| Stream | 12 | 13 | 15 | 17 | 14 | 18 | 19 | 34 | 42 |
|---|---|---|---|---|---|---|---|---|---|
| Temperature (° C.) | 48.9 | −28.9 | −34.4 | −34.3 | −40.8 | 105.7 | −99.4 | −79.5 | −106.7 |
| Temperature (° F.) | 120 | −20 | −30 | −29.68 | −41.5 | 222.3 | −147.0 | −111.1 | −160.1 |
| Pressure (bar) | 28.6 | 28.3 | 1.5 | 1.4 | 27.9 | 28.3 | 27.6 | 26.9 | 26.5 |
| Pressure (psia) | 415 | 410 | 21.88 | 20.88 | 405 | 410 | 400 | 390 | 385 |
| Mass Flow Rate (kg/h) | 11181 | 11181 | 9652 | 9652 | 10542 | 2888 | 10542 | 6060 | 6672 |
| Mass Flow Rate (lb/h) | 24650 | 24650 | 21280 | 21280 | 23240 | 6366 | 23240 | 13360 | 14710 |
| Component (Mole %) | | | | | | | | | |
| Methane | 0.7327 | 0.7327 | 0 | 0 | 0.7350 | 0 | 0.7350 | 0.5860 | 0.8068 |
| Ethane | 0.0768 | 0.0768 | 0.0150 | 0.0150 | 0.1656 | 0.0095 | 0.1656 | 0.3592 | 0.0005 |
| Propane | 0.0629 | 0.0629 | 0.9800 | 0.9800 | 0.0285 | 0.4735 | 0.0285 | 0.0408 | 0 |
| i-Butane | 0.0113 | 0.0113 | 0.0050 | 0.0050 | 0 | 0.1060 | 0 | 0 | 0 |
| n-Butane | 0.0270 | 0.0270 | 0 | 0 | 0 | 0.2533 | 0 | 0 | 0 |
| i-Pentane | 0.0065 | 0.0065 | 0 | 0 | 0 | 0.0611 | 0 | 0 | 0 |
| n-Pentane | 0.0066 | 0.0066 | 0 | 0 | 0 | 0.0619 | 0 | 0 | 0 |
| n-Heptane | 0.0037 | 0.0037 | 0 | 0 | 0 | 0.0347 | 0 | 0 | 0 |
| Carbon Dioxide | 0.0025 | 0.0025 | 0 | 0 | 0.0045 | 0 | 0.0045 | 0.0139 | 0.0002 |
| Nitrogen | 0.0700 | 0.0700 | 0 | 0 | 0.0664 | 0 | 0.0664 | 0 | 0.1926 |

TABLE 6-continued

| Stream | 43 | 35 | 51 | 39 | 28 | 26 |
|---|---|---|---|---|---|---|
| Temp. (° C.) | 43.3 | −113.9 | −92.1 | −40 | −40 | −40 |
| Temp. (° F.) | 110 | −173.0 | −133.8 | −40 | −40 | −40 |
| Pressure (bar) | 26.2 | 6.4 | 26.8 | 29.1 | 29.1 | 29.1 |
| Pressure (psia) | 380 | 92.72 | 388.9 | 422 | 422 | 422 |
| Mass Flow Rate (kg/h) | 6672 | 6060 | 4808 | 6060 | 3807 | 2252 |
| Mass Flow Rate (lb/h) | 14710 | 13360 | 10600 | 13360 | 8394 | 4964 |
| Component (Mole %) | | | | | | |
| Methane | 0.8068 | 0.5860 | 0.8234 | 0.5860 | 0.7246 | 0.2604 |
| Ethane | 0.0005 | 0.3592 | 0.1474 | 0.3592 | 0.2503 | 0.6152 |
| Propane | 0 | 0.0408 | 0.0240 | 0.0408 | 0.0110 | 0.1108 |
| i-Butane | 0 | 0 | 0 | 0 | 0 | 0 |
| n-Butane | 0 | 0 | 0 | 0 | 0 | 0 |
| i-Pentane | 0 | 0 | 0 | 0 | 0 | 0 |
| n-Pentane | 0 | 0 | 0 | 0 | 0 | 0 |
| n-Heptane | 0 | 0 | 0 | 0 | 0 | 0 |
| $CO_2$ | 0.0002 | 0.0139 | 0.0047 | 0.0139 | 0.0140 | 0.0136 |
| Nitrogen | 0.1926 | 0 | 0.0005 | 0 | 0 | 0 |

| Stream | 413 | 47 | 49 | 48 |
|---|---|---|---|---|
| Temp. (° C.) | 48.9 | 48.9 | 8.5 | 48.8 |
| Temp. (° F.) | 120 | 120 | 47.27 | 119.8 |
| Pressure (bar) | 28.3 | 27.6 | 64.8 | 27.6 |
| Pressure (psia) | 410 | 400 | 940 | 400 |
| Mass Flow Rate (kg/h) | 3202 | 2791 | 681 | 7598 |
| Mass Flow Rate (lb/h) | 7060 | 6152 | 1501 | 16750 |
| Component (Mole %) | | | | |
| Methane | 0.7960 | 0.8970 | 0.3678 | 0.8520 |
| Ethane | 0.0003 | 0.0007 | 0 | 0.0904 |
| Propane | 0 | 0 | 0 | 0.0147 |
| i-Butane | 0 | 0 | 0 | 0 |
| n-Butane | 0 | 0 | 0 | 0 |
| i-Pentane | 0 | 0 | 0 | 0 |
| n-Pentane | 0 | 0 | 0 | 0 |
| n-Heptane | 0 | 0 | 0 | 0 |
| $CO_2$ | 0.0001 | 0.0003 | 0 | 0.0030 |
| Nitrogen | 0.2035 | 0.1020 | 0.6322 | 0.0400 |

Results from the above simulations, including required membrane surface area and nitrogen recovery unit (NRU) power requirements are summarized in Table 7.

TABLE 7

| | Example | | | |
|---|---|---|---|---|
| | 2 | 3 | 4 | 5 |
| NRU Power Requirements (kW) | 1467 | 342 | 371 | 579 |
| NRU Power Requirements (hp) | 1967 | 459 | 497 | 776 |
| Stage 1 Membrane Area (m2) | 1010 | 456 | 207 | 206 |
| Stage 2 Membrane Area (m2) | 1105 | 74 | 57 | 260 |

Compared to Example 2, Example 3 shows the changes in membrane and compression requirements that may be achieved according to embodiments disclosed herein, where the mixed refrigerant is divided before going to the absorber. Power requirements of the nitrogen recovery unit are reduced from about 197 to 82 hp per million standard cubic feet of gas from the field, along with reducing the membrane area to about 25 percent of that required in Example 2. This is a drastic reduction, far exceeding what one skilled in the art may expect by pulling a slip stream of gas out of the iso-pressure open refrigeration unit for blending, and greatly improving NGL processing economics, where such economics may allow for even small fields of high nitrogen gas to be brought into production. Example 4 includes a side draw from the absorber to remove low nitrogen gas from the iso-pressure open refrigeration system, and utilizes a high pressure membrane NRU, resulting in a further reduction in required membrane area as compared to Example 3.

Example 5 illustrates the benefits of integrating the nitrogen removal unit with the iso-pressure open refrigeration system. As shown by Example 5, the overall material balance of the gas processing facility can be altered, providing more salable products while consuming less power and requiring a significantly smaller membrane area as compared to Example 2. In Example 5, recycle of a medium btu gas may provide for a high methane recovery. In Example 5, only about 3% of the inlet methane is lost as low btu gas in a nitrogen purge stream. Power consumption is also well below that of Example 2. Compared to Example 2, Example 4 recovers 4.7% more methane while reducing net nitrogen recovery unit horsepower.

As shown by the above Examples, the response of the mixed refrigerant system provided by embodiments disclosed herein greatly enhances the nitrogen separation and provides an adaptable system for processing of NGLs. The iso-pressure open refrigeration system allows for colder refrigeration temperatures without increasing the pressure ratio of refrigeration compression. Further, the iso-pressure open refrigeration system may be exploited, providing for both NGL recovery and nitrogen separation, vastly improving the economics for NGL processing as compared to prior art unit operations having a conventional NGL recovery in series with nitrogen removal.

Processes according to embodiments disclosed herein counter-intuitively allow for lower temperatures at higher suction pressures. In most refrigeration systems, a lower suction pressure is required to achieve colder temperatures. However, comparing stream 35, the mixed refrigerant, in Example 2 the mixed refrigerant is at a temperature of −85.3° C. (−121.5° F.) and a pressure of 4 bar (57.65 psia), and having a flow rate of 1871 kg/h (4124 lb/h); however, in Example 3, the mixed refrigerant is at a temperature of −106.4° C. (−159.5° F.) and a pressure of 14.2 bar (206 psia), and having a flow rate of 3646 kg/h (8039 lb/h). By advantageously manipulating stream compositions, processes disclosed herein allow for additional mixed refrigerant to be produced having a higher methane content, resulting in colder temperatures at higher suction pressures. Such advantageous processing afforded by embodiments disclosed herein allows for the production of an essentially nitrogen-free natural gas that may be exported and blended with high nitrogen content gas, where such processing provides for nitrogen recovery units having lower required duties, lower required membrane surface area, and a lower overall processing cost.

As described above, embodiments disclosed herein relate to a system for the efficient separation of natural gas from nitrogen. More specifically, embodiments disclosed herein allow for the efficient separation of natural gas from nitrogen using iso-pressure open-loop refrigeration.

Among the advantages of processes disclosed herein is that the reflux to the distillation column is enriched, for example, in ethane, reducing loss of propane from the distillation column. The reflux also increases the mole fraction of lighter hydrocarbons, such as ethane, in the distillation column, making it easier to condense the overhead stream. Further, processes disclosed herein use the liquid condensed in the distillation column overhead twice, once as a low temperature refrigerant and a second time as a reflux stream for the distillation column.

Advantageously, embodiments disclosed herein may provide for the production of natural gas sales streams from produced gas streams containing more than 4 mole % inert components, using an open-loop refrigeration system integrated with a nitrogen recovery unit. Integration of high-purity natural gas streams according to embodiments disclosed herein may provide for decreased energy and membrane surface area requirements as compared to typical natural gas separation processes. More specifically, it has been found that by proper utilization of process flow streams, a natural gas product stream meeting compositional requirements may be produced with exceptional process efficiency using embodiments disclosed herein. Integration of iso-pressure open refrigeration and nitrogen recovery according to embodiments described herein allows for the advantageous use of low-nitrogen content streams, resulting in efficient separations having low utility requirements, membrane surface area requirements, process flexibility and other advantages as described above. The integration of iso-pressure open refrigeration and nitrogen removal provides surprising synergies over the processing of natural gas in series with nitrogen removal. Processes disclosed herein may thus allow for not only the efficient separation of low-nitrogen content natural gas streams, the advantages afforded by processes disclosed herein also allow for high-nitrogen content natural gas streams, for which it was previously not economically feasible, to be produced.

While the disclosure includes a limited number of embodiments, those skilled in the art, having benefit of this disclosure, will appreciate that other embodiments may be devised which do not depart from the scope of the present disclosure. Accordingly, the scope should be limited only by the attached claims.

What is claimed is:

1. A process for recovery of natural gas liquids, comprising:

fractionating a gas stream comprising nitrogen, methane, ethane, and propane and other $C_{3+}$ hydrocarbons in a fractionator into at least two fractions including a light fraction comprising nitrogen, methane, ethane, and propane, and a heavy fraction comprising propane and other $C_{3+}$ hydrocarbons;

separating the light fraction into at least three fractions, including an overheads fraction enriched in nitrogen, a bottoms fraction depleted in nitrogen, and a side draw fraction of intermediate nitrogen content, in a first separator;

separating the nitrogen-depleted fraction into a propane-enriched fraction and a propane-depleted fraction in a second separator;

feeding at least a portion of the propane-enriched fraction to the fractionator as a reflux;

recycling a portion of the propane-depleted fraction to the first separator; and withdrawing a portion of the propane-depleted fraction as a natural gas liquids product stream.

2. The process of claim 1, wherein the natural gas liquids product stream comprises 4 mole % or less nitrogen.

3. The process of claim 1, further comprising admixing at least a portion of the side draw fraction of intermediate nitrogen content with the withdrawn portion to form the natural gas liquids product stream.

4. The process of claim 3, wherein the admixture comprises 4 mole % or less nitrogen.

5. The process of claim 1, further comprising exchanging heat between two or more of the gas stream, the light fraction, the withdrawn portion, the nitrogen-enriched fraction, the nitrogen-depleted fraction, the intermediate nitrogen content fraction, and a refrigerant.

6. The process of claim 1, further comprising separating at least one of the nitrogen-enriched fraction and the intermediate nitrogen content fraction in a nitrogen removal unit to produce a nitrogen-depleted natural gas stream and a nitrogen-enriched natural gas stream.

7. The process of claim 6, further comprising admixing the withdrawn portion with at least a portion of at least one of the side draw fraction, the nitrogen-depleted natural gas stream, and the nitrogen-enriched natural gas stream to form the natural gas liquids product stream.

8. The process of claim 7, wherein the admixture comprises 4 mole % or less nitrogen.

9. A process for recovery of natural gas liquids, comprising:

fractionating a gas stream comprising nitrogen, methane, ethane, and propane and other $C_{3+}$ hydrocarbons in a fractionator into at least two fractions including a light fraction comprising nitrogen, methane, ethane, and propane, and a heavy fraction comprising propane and other $C_{3+}$ hydrocarbons;

separating the light fraction into at least two fractions including a nitrogen-enriched fraction and a nitrogen-depleted fraction in a first separator;

compressing and cooling the nitrogen-depleted fraction;

separating the compressed and cooled nitrogen-depleted fraction into a propane-enriched fraction and a propane-depleted fraction in a second separator;

feeding at least a portion of the propane-enriched fraction to the fractionator as a reflux;

feeding a portion of the propane-depleted fraction to the first separator;

withdrawing a portion of the propane-depleted fraction;

exchanging heat between two or more of the gas stream, the light fraction, a portion of the propane-depleted fraction, the nitrogen-enriched fraction, the nitrogen-depleted fraction, the withdrawn portion, the compressed and cooled nitrogen-depleted fraction, and a refrigerant; and separating the nitrogen-enriched fraction in a nitrogen removal unit comprising:

separating the nitrogen-enriched fraction in a first membrane separation stage to produce a first nitrogen-depleted natural gas stream and a first nitrogen-enriched natural gas stream;

separating the nitrogen-enriched fraction in a second membrane separation stage to produce a second nitrogen-depleted natural gas stream and a second nitrogen-enriched natural gas stream; and recycling at least a portion of the second nitrogen-depleted natural gas stream to the separating in a first membrane separation stage; and admixing the withdrawn portion and the first nitrogen-depleted natural gas stream to form a natural gas product stream.

10. A process for recovery of natural gas liquids, comprising:

fractionating a gas stream comprising nitrogen, methane, ethane, and propane and other $C_{3+}$ hydrocarbons in a fractionator into at least two fractions including a light fraction comprising nitrogen, methane, ethane, and propane, and a heavy fraction comprising propane and other $C_{3+}$ hydrocarbons;

separating the light fraction into at least three fractions including a nitrogen-enriched fraction, an intermediate nitrogen-content fraction, and a nitrogen-depleted fraction in a first separator;

compressing and cooling the nitrogen-depleted fraction;

separating the compressed and cooled nitrogen-depleted fraction into a propane-enriched fraction and a propane-depleted fraction in a second separator;

feeding at least a portion of the propane-enriched fraction to the fractionator as a reflux;

recycling at least a portion of the propane-depleted fraction to the first separator;

exchanging heat between two or more of the gas stream, the light fraction, a portion of the propane-depleted fraction, the nitrogen-enriched fraction, the nitrogen-depleted fraction, the compressed and cooled nitrogen-depleted fraction, the intermediate nitrogen-content fraction, and a refrigerant; and separating the nitrogen-enriched fraction in a nitrogen removal unit comprising:

separating the nitrogen-enriched fraction in a first membrane separation stage to produce a first nitrogen-depleted natural gas stream and a first nitrogen-enriched natural gas stream;

separating the nitrogen-enriched fraction in a second membrane separation stage to produce a second nitrogen-depleted natural gas stream and a second nitrogen-enriched natural gas stream; and recycling at least a portion of the second nitrogen-depleted natural gas stream to the separating in a first membrane separation stage; and admixing the intermediate nitrogen-content fraction and the first nitrogen-depleted natural gas stream to form a natural gas product stream.

11. The process of claim 1, wherein the first separator is an absorber column.

12. The process of claim 6, wherein the nitrogen removal unit comprises at least one membrane separation stage.

13. The process of claim 9, wherein the first separator is an absorber column.

14. The process of claim 9, wherein the natural gas liquids product stream comprises 4 mole % or less nitrogen.

15. The process of claim 9, further comprising exchanging heat between two or more of the gas stream, the light fraction, the nitrogen-enriched fraction, the nitrogen-depleted fraction, the intermediate nitrogen content fraction, and a refrigerant.

16. The process of claim 10, wherein the first separator is an absorber column.

17. The process of claim 10, wherein the natural gas liquids product stream comprises 4 mole % or less nitrogen.

18. The process of claim 10, further comprising exchanging heat between two or more of the gas stream, the light fraction, the nitrogen-enriched fraction, the nitrogen-depleted fraction, the intermediate nitrogen content fraction, and a refrigerant.

* * * * *